US012403994B2

(12) United States Patent
Ahlswede et al.

(10) Patent No.: US 12,403,994 B2
(45) Date of Patent: Sep. 2, 2025

(54) TILLERS FOR MARINE DRIVES HAVING TILT MECHANISM

(71) Applicant: Brunswick Corporation, Mettawa, IL (US)

(72) Inventors: Scott G. Ahlswede, Plymouth, WI (US); Gary D. Needham, Stillwater, OK (US); Robert A. Podell, Slinger, WI (US); Andrew J. Przybyl, Berlin, WI (US); Matthew S. Dawes, Stillwater, OK (US)

(73) Assignee: Brunswick Corporation, Mettawa, IL (US)

( * ) Notice: Subject to any disclaimer, the term of this patent is extended or adjusted under 35 U.S.C. 154(b) by 531 days.

(21) Appl. No.: 17/881,018

(22) Filed: Aug. 4, 2022

(65) Prior Publication Data

US 2023/0257091 A1 Aug. 17, 2023

Related U.S. Application Data

(60) Provisional application No. 63/310,369, filed on Feb. 15, 2022.

(51) Int. Cl.
*B63H 20/10* (2006.01)

(52) U.S. Cl.
CPC ..... *B63H 20/10* (2013.01)

(58) Field of Classification Search
CPC ..... B63H 20/10
See application file for complete search history.

(56) References Cited

U.S. PATENT DOCUMENTS 1,854,196 A 4/1932 Irgens
2,019,136 A 10/1935 Johnson
(Continued)

FOREIGN PATENT DOCUMENTS

AU 2019100942 9/2019
CA 2367740 7/2002
(Continued)

OTHER PUBLICATIONS

Partial EP Search Report issued in European Patent Application No. 23156070.7, dated Jul. 14, 2023.
(Continued)

*Primary Examiner* — Stephen P Avila
(74) *Attorney, Agent, or Firm* — Andrus Intellectual Property Law, LLP

(57) ABSTRACT

A tiller is for controlling a marine drive. The tiller has a base bracket assembly and a tiller arm which is extends outwardly from the base bracket assembly. The base bracket assembly is configured to facilitate yaw adjustment of the tiller arm, in particular into and between a variety of yaw positions relative to the base bracket assembly. The tiller arm has a grip restraining device which is located on the bottom of the middle portion of the tiller arm and is manually accessible from both sides of the tiller arm. The grip restraining device is specially configured to selectively restrain rotation of a hand grip on the outer end of the tiller arm. The tiller arm also has a tilt mechanism which facilitates tilting of the tiller arm relative to the base bracket assembly into and between a variety of tilt positions, including a straight upward tilt position and a straight downward tilt position.

25 Claims, 25 Drawing Sheets

(56) References Cited

U.S. PATENT DOCUMENTS 2,363,854 A 11/1944 Bierenfeld
D188,325 S 7/1960 Brown
3,018,754 A * 1/1962 Snyder ..... B63H 20/12 440/63
3,148,557 A 9/1964 Shimanckas
3,636,911 A 1/1972 Piazza
3,693,576 A 9/1972 Driscoll
3,865,334 A 2/1975 Wair, Jr.
3,955,527 A 5/1976 Holtermann
3,961,595 A 6/1976 Meyer
D246,853 S 1/1978 Berchem
4,071,002 A 1/1978 Frahm
4,295,835 A 10/1981 Mapes et al.
4,318,699 A 3/1982 Wenstadt et al.
4,331,431 A 5/1982 Estes
D272,357 S 1/1984 Hall et al.
4,447,214 A 5/1984 Henrich
D276,811 S 12/1984 Wolfe
4,496,326 A 1/1985 Boda
4,504,778 A 3/1985 Evans
4,521,201 A 6/1985 Watanabe
4,582,493 A 4/1986 Toyohara
4,650,429 A 3/1987 Boda
4,669,987 A 6/1987 Schulte
4,701,141 A 10/1987 Sumigawa
D295,867 S 5/1988 Walsh
4,800,854 A 1/1989 Boda et al.
4,838,820 A 6/1989 Boda et al.
4,878,468 A 11/1989 Boda et al.
4,895,154 A 1/1990 Bartelt
4,897,061 A 1/1990 Koepsel et al.
4,911,665 A 3/1990 Hetzel
5,072,809 A 12/1991 Shibata
D323,508 S 1/1992 Hirshberg et al.
5,145,427 A 9/1992 Kawai et al.
D332,265 S 1/1993 Osumi
5,180,320 A 1/1993 Calamia et al.
D341,365 S 11/1993 Little et al.
D343,625 S 1/1994 Walthall
5,277,634 A 1/1994 Calamia et al.
5,340,342 A 8/1994 Boda et al.
D352,723 S 11/1994 DeBraal et al.
5,378,178 A 1/1995 Haman
D359,290 S 6/1995 Takeuchi
5,509,836 A 4/1996 Ogasawara et al.
5,540,606 A 7/1996 Strayhorn
D373,113 S 8/1996 Stringer
5,632,657 A 5/1997 Henderson
D380,478 S 7/1997 Robbins
D387,775 S 12/1997 Iekura
5,707,262 A 1/1998 Huntley et al.
5,756,949 A 5/1998 Sato
5,797,777 A 8/1998 Tsunekawa et al.
D412,911 S 8/1999 Iekura
5,967,866 A 10/1999 Willows et al.
D416,871 S 11/1999 Todd
D418,519 S 1/2000 Iekura
6,020,563 A 2/2000 Risk, Jr. et al.
D421,444 S 3/2000 Hatch et al.
D428,616 S 7/2000 Iekura
6,093,066 A 7/2000 Isogawa et al.
6,109,986 A 8/2000 Gaynor et al.
6,146,221 A 11/2000 Natsume
D438,493 S 3/2001 Mulliniks et al.
6,264,513 B1 7/2001 Marsh
6,264,516 B1 7/2001 McEathron et al.
D447,123 S 8/2001 Winkler
6,273,771 B1 8/2001 Buckley et al.
D448,037 S 9/2001 Westimayer et al.
6,352,456 B1 3/2002 Jaszewski et al.
D457,166 S 5/2002 Burmeister et al.
6,382,122 B1 5/2002 Gaynor et al.
D458,273 S 6/2002 Burmeister et al.
6,406,342 B1 6/2002 Walczak et al.
6,406,343 B2 6/2002 Kawai et al.
D460,459 S 7/2002 Hansen
D460,465 S 7/2002 Williams
D460,972 S 7/2002 Osumi
D462,363 S 9/2002 Burmeister et al.
D463,447 S 9/2002 Osumi et al.
D463,448 S 9/2002 Osumi et al.
D463,449 S 9/2002 Osumi
D463,800 S 10/2002 Osumi
D466,907 S 12/2002 Ohsumi
6,494,431 B1 12/2002 McCoy
D470,154 S 2/2003 Burmeister et al.
6,524,148 B2 2/2003 Yoshigasaki et al.
D474,480 S 5/2003 Zebley, Jr. et al.
D474,784 S 5/2003 Sanschagrin et al.
6,558,213 B1 5/2003 McGowan
D478,597 S 8/2003 Zebley, Jr.
6,648,703 B2 11/2003 McChesney et al.
6,663,450 B1 12/2003 Walczak et al.
D485,847 S 1/2004 Sanschagrin et al.
D485,848 S 1/2004 Sanschagrin et al.
D486,500 S 2/2004 Okamoto
D489,380 S 5/2004 Ohsumi et al.
D495,345 S 8/2004 Farlow et al.
D495,716 S 9/2004 Sanschagrin et al.
D497,370 S 10/2004 Katoh
D498,485 S 11/2004 Kuwae
D498,764 S 11/2004 Sanschagrin et al.
D500,056 S 12/2004 DeYoung et al.
6,875,066 B2 4/2005 Wolaver
6,902,450 B2 6/2005 Ohtsuki et al.
6,914,202 B2 7/2005 Sugimoto et al.
7,001,231 B1 2/2006 Halley et al.
D517,096 S 3/2006 Landers et al.
7,090,551 B1 8/2006 Lokken et al.
D527,737 S 9/2006 Lekura
D528,128 S 9/2006 Sanschagrin et al.
D528,563 S 9/2006 Sanschagrin et al.
D531,639 S 11/2006 Okamoto
D531,640 S 11/2006 Okamoto
D536,704 S 2/2007 Iekura
D537,838 S 3/2007 Iekura
7,210,973 B2 5/2007 Sanschagri et al.
7,214,113 B2 5/2007 Kojima
D549,240 S 8/2007 Okamoto
7,267,592 B1 9/2007 Ingebritson et al.
D552,129 S 10/2007 Steinberg
D552,130 S 10/2007 Steinberg et al.
D560,050 S 1/2008 Tokach et al.
D563,907 S 3/2008 Badarello
D565,607 S 4/2008 Moen et al.
7,404,747 B2 7/2008 Shinde et al.
D578,274 S 10/2008 Tokach et al.
7,442,104 B2 10/2008 Okabe
7,455,558 B2 11/2008 Yander
D584,317 S 1/2009 Okamoto
D589,981 S 4/2009 Iekura
7,553,206 B2 6/2009 Hasegawa et al.
7,666,038 B2 2/2010 Yomo et al.
D611,062 S 3/2010 Okamoto
D611,063 S 3/2010 Okamoto
D611,501 S 3/2010 Vignau et al.
D611,502 S 3/2010 Vignau et al.
7,677,938 B2 3/2010 Wiatrowski et al.
7,704,110 B2 4/2010 Wiatrowski et al.
7,736,207 B2 6/2010 Vignau
D623,661 S 9/2010 Yamagishi et al.
D624,567 S 9/2010 Kelley
D626,975 S 11/2010 Ryczek et al.
D629,818 S 12/2010 Rummer et al.
D635,154 S 3/2011 Rummer et al.
7,895,959 B1 3/2011 Angel et al.
D635,586 S 4/2011 Okamoto
7,976,354 B2 7/2011 Kubota et al.
D643,440 S 8/2011 Dannenberg et al.
8,106,617 B1 1/2012 Holley
D655,308 S 3/2012 Steinberg
D655,320 S 3/2012 Hiraoka et al.
D657,400 S 4/2012 Loew
D660,323 S 5/2012 Hiraoka et al.

(56) References Cited

U.S. PATENT DOCUMENTS

| | | | |
|---|---|---|---|
| D660,614 | S | 5/2012 | Palmeiri |
| D663,321 | S | 7/2012 | Okamoto |
| 8,257,122 | B1 | 9/2012 | Holley |
| 8,651,906 | B1 | 2/2014 | Morton |
| D706,313 | S | 6/2014 | Higashikawa et al. |
| D707,729 | S | 6/2014 | Jackson et al. |
| D708,233 | S | 7/2014 | Furuki et al. |
| D709,918 | S | 7/2014 | Jones, Sr. |
| D712,931 | S | 9/2014 | Matsumoto |
| D714,345 | S | 9/2014 | Petit et al. |
| D715,333 | S | 10/2014 | Jacobsthal et al. |
| D716,846 | S | 11/2014 | Carter et al. |
| 8,930,050 | B2 | 1/2015 | Garon et al. |
| D727,969 | S | 4/2015 | Okamoto |
| 9,004,964 | B2 | 4/2015 | Grez |
| D728,640 | S | 5/2015 | Turner et al. |
| 9,039,469 | B1 | 5/2015 | Calamia et al. |
| 9,073,616 | B1 | 7/2015 | Wiegele et al. |
| 9,109,616 | B1 | 8/2015 | Ballentine |
| D740,858 | S | 10/2015 | Dannenberg et al. |
| 9,180,950 | B1 | 11/2015 | Davenport et al. |
| 9,205,906 | B1 | 12/2015 | Eichinger |
| 9,216,805 | B1 | 12/2015 | Amerling et al. |
| D757,126 | S | 5/2016 | Vaninetti et al. |
| 9,359,059 | B1 | 6/2016 | Scherer, III et al. |
| 9,359,981 | B1 | 6/2016 | Waisanen et al. |
| 9,376,194 | B1 | 6/2016 | Jensen et al. |
| 9,422,045 | B2 | 8/2016 | Kinpara et al. |
| 9,481,438 | B1 | 11/2016 | Tuchscherer |
| 9,580,947 | B1 | 2/2017 | Amerling et al. |
| 9,587,601 | B1 | 3/2017 | Ochiai |
| D791,189 | S | 7/2017 | Scherer, III et al. |
| 9,694,892 | B1 | 7/2017 | Anschuetz et al. |
| 9,701,383 | B1 | 7/2017 | Stuber et al. |
| D794,078 | S | 8/2017 | Vaninetti |
| D794,079 | S | 8/2017 | Vaninetti et al. |
| 9,764,813 | B1 | 9/2017 | Zarembka et al. |
| 9,783,278 | B1 | 10/2017 | Dannenberg et al. |
| 9,789,945 | B1 | 10/2017 | Vaninetti et al. |
| 9,840,316 | B1 | 12/2017 | Jaszewski |
| D806,752 | S | 1/2018 | Vaninetti et al. |
| D807,920 | S | 1/2018 | Vaninetti |
| D809,017 | S | 1/2018 | Noda et al. |
| 9,868,501 | B1 | 1/2018 | Gable et al. |
| 9,926,064 | B1 | 3/2018 | Tuchscherer |
| D816,716 | S | 5/2018 | Abellera et al. |
| D832,472 | S | 10/2018 | Davis et al. |
| D834,617 | S | 11/2018 | Zin et al. |
| D834,618 | S | 11/2018 | Zin et al. |
| D835,675 | S | 12/2018 | Nakaura et al. |
| 10,155,578 | B1 | 12/2018 | Osthelder et al. |
| D842,504 | S | 3/2019 | Davis et al. |
| 10,246,173 | B1 | 4/2019 | Ingebritson |
| D852,230 | S | 6/2019 | Zin et al. |
| D852,848 | S | 7/2019 | Zin et al. |
| D852,849 | S | 7/2019 | Zin et al. |
| D852,850 | S | 7/2019 | Zin et al. |
| 10,343,759 | B2 | 7/2019 | Despineux |
| D859,469 | S | 9/2019 | Zin et al. |
| 10,507,898 | B1 | 12/2019 | Belter et al. |
| 10,578,042 | B2 | 3/2020 | Buis |
| D886,865 | S | 6/2020 | Bailey |
| 10,696,367 | B1 | 6/2020 | Ingebritson et al. |
| 10,723,429 | B1 | 7/2020 | Wiatrowski et al. |
| 10,787,236 | B1 | 9/2020 | Erickson |
| D911,296 | S | 2/2021 | Li |
| 10,940,917 | B2 | 3/2021 | Montague et al. |
| D917,565 | S | 4/2021 | Vaninetti et al. |
| 10,981,639 | B2 | 4/2021 | Kimpara et al. |
| 11,084,563 | B1 | 8/2021 | Pielow et al. |
| 11,097,824 | B1 | 8/2021 | Anderson, Jr. |
| 11,097,826 | B1 | 8/2021 | Dannenberg et al. |
| 11,186,352 | B1 | 11/2021 | Ingebritson et al. |
| 11,352,118 | B1 | 6/2022 | Dengel et al. |
| 11,628,919 | B1 | 4/2023 | Pielow et al. |
| 2002/0142680 | A1 | 10/2002 | Anderson |
| 2003/0024456 | A1 | 2/2003 | Swetish |
| 2003/0176121 | A1 | 9/2003 | Kitsu |
| 2003/0194927 | A1 | 10/2003 | Sanschagrin et al. |
| 2003/0232548 | A1 | 12/2003 | Alby et al. |
| 2004/0107789 | A1 | 6/2004 | Peppard |
| 2004/0121667 | A1 | 6/2004 | Okabe |
| 2004/0137806 | A1 | 7/2004 | Ohtsuki et al. |
| 2005/0262958 | A1 | 12/2005 | Kojima |
| 2006/0172631 | A1 | 8/2006 | Kameoka |
| 2007/0042652 | A1 | 2/2007 | Kitsu et al. |
| 2007/0197109 | A1 | 8/2007 | Yander |
| 2008/0038967 | A1 | 2/2008 | Shinde |
| 2008/0268729 | A1 | 10/2008 | Yomo et al. |
| 2009/0075534 | A1 | 3/2009 | Wiatrowski et al. |
| 2010/0147257 | A1 | 6/2010 | Yazaki et al. |
| 2011/0104963 | A1 | 5/2011 | Ellis |
| 2013/0280970 | A1 | 10/2013 | Clarkson et al. |
| 2014/0057508 | A1 | 2/2014 | Litjens et al. |
| 2014/0306505 | A1 | 10/2014 | Koch |
| 2016/0023740 | A1 | 1/2016 | Skrzypchak et al. |
| 2017/0043787 | A1 | 2/2017 | Mangette et al. |
| 2017/0306830 | A1 | 10/2017 | Bruestle et al. |
| 2019/0176952 | A1 | 6/2019 | Clark et al. |
| 2020/0156751 | A1 | 5/2020 | Skrzypchak et al. |
| 2020/0172220 | A1 | 6/2020 | Chung et al. |
| 2021/0061431 | A1 | 3/2021 | McGinley |
| 2023/0102741 | A1 | 3/2023 | Fergus et al. |
| 2023/0257091 | A1 | 8/2023 | Ahlswede |
| 2023/0257092 | A1 | 8/2023 | Ahlswede et al. |
| 2023/0257094 | A1 | 8/2023 | Jaszewski et al. |

FOREIGN PATENT DOCUMENTS

| | | | |
|---|---|---|---|
| CA | 2453466 | A1 | 6/2004 |
| EP | 1101696 | | 5/2001 |
| EP | 1400720 | | 3/2004 |
| EP | 3326903 | | 4/2019 |
| EP | 4155191 | A1 | 3/2023 |
| JP | S60 38293 | | 2/1985 |
| JP | 2002211489 | | 7/2002 |
| JP | 3946315 | | 7/2007 |
| JP | 4094151 | | 6/2008 |
| JP | 2010058770 | | 3/2010 |
| JP | 2011-213215 | | 10/2011 |
| JP | 2013-173423 | | 9/2013 |
| JP | 5604939 | | 10/2014 |
| JP | 5741259 | | 7/2015 |
| JP | 5927980 | | 6/2016 |
| WO | 2004-035381 | | 4/2004 |
| WO | 2007097057 | | 8/2007 |
| WO | 2023114098 | A1 | 6/2023 |

OTHER PUBLICATIONS

Partial EP Search Report issued in European Patent Application No. 23156071.5, dated Jul. 14, 2023.

Belter, Unpublished U.S. Appl. No. 18/047,360, filed Oct. 18, 2022, "Configurable Shift and Throttle Mechanism for Tiller of Marine Drive" (specification and drawings only).

Erikson, et al., "Tiller Tilt Lock and Automatic Release System", Unpublished U.S. Appl. No. 16/257,380, filed Jan. 25, 2019 (specification and drawings only).

Mercury Marine, 15/20hp EFI Fourstroke Outboard Tiller, tiller handle, available at least as early as Nov. 17, 2017.

Mercury Marine, Big Tiller for 75-300 HP Mercury Outboards, tiller handle, available at least as early as 2018, admitted prior art.

Pielow et al., "Tiller for Outboard Motor," Unpublished U.S. Appl. No. 16/718,566, filed Dec. 18, 2019 (specification and drawings only).

Vaninetti et al., "Tiller for Outboard Motor," Unpublished U.S. Appl. No. 29/610,556, filed Jul. 13, 2017.

Extended European Search Report issued in EP Application No. 22211031.4, dated May 17, 2023.

Extended European Search Report for Corresponding EP Application No. 23 156069.9, dated Jul. 10, 2023.

(56) References Cited

OTHER PUBLICATIONS

Fergus, et al., Unpublished U.S. Appl. No. 17/487,116.
Jaszewski, et al., Unpublished U.S. Appl. No. 17/585,214.
Extended European search report issued in EP Application No. 25158527.9, dated May 26, 2025.

* cited by examiner

TILLERS FOR MARINE DRIVES HAVING TILT MECHANISM

CROSS-REFERENCE TO RELATED APPLICATION

The present application claims the benefit of and priority to U.S. Provisional Patent Application Ser. No. 63/310,369, filed Feb. 15, 2022, which is incorporated herein by reference.

FIELD

The present disclosure relates to marine drives and particularly to tillers for marine drives.

BACKGROUND

The following U.S. patents are incorporated herein by reference in entirety.

U.S. Pat. No. 11,186,352 discloses a tiller system for steering a marine propulsion device. The tiller system includes a tiller arm rotatably coupled to the marine propulsion device. The tiller arm is rotatable from a down position to an up position through a plurality of lock positions therebetween. A toothed member is coupled to one of the tiller arm and the marine propulsion device. The toothed member defines a plurality of teeth corresponding to the plurality of lock positions for the tiller arm. A pawl is coupled to another of the tiller arm and the marine propulsion device, where the pawl engages with the plurality of teeth to prevent the tiller arm from rotating downwardly through the plurality of lock positions.

U.S. Pat. No. 11,097,826 discloses a tiller for an outboard marine drive including a tiller body that is elongated along a tiller axis between a fixed end connected to an outboard marine drive and a distal end. A lanyard switch on the tiller body is configured to prevent operation of the outboard marine drive when a lanyard clip is not attached to the lanyard switch. A controller is configured to identify that an operator has provided user input to start the outboard marine drive and that the lanyard clip is not connected to the lanyard switch. The controller then generates a lanyard error alert identifying that the lanyard clip is not connected to the lanyard switch.

U.S. Pat. No. 10,787,236 discloses a tiller system for steering an outboard motor. The tiller system includes a tiller arm that is rotatably coupled to the outboard motor. The tiller arm is rotatable from a down position to an up position through a plurality of lock positions therebetween. A tilt lock system is coupled between the tiller arm and the outboard motor and is configured to be activated and deactivated. When activated, the tilt lock system prevents the tiller arm from rotating downwardly through each of the plurality of lock positions. The tiller arm is further rotatable into an unlock position, whereby rotating the tiller arm into the unlock position automatically deactivates the tilt lock system such that the tiller arm is freely rotatable downwardly through the plurality of lock positions.

U.S. Pat. No. 10,696,367 discloses a tiller for an outboard motor has a throttle grip which is manually rotatable through first and second ranges of motion into and between an idle position in which the outboard motor is controlled at an idle speed, and first and second open-throttle positions, respectively, in which the outboard motor is controlled at an above-idle speed. A throttle shaft is coupled to the throttle grip and is configured so that rotation of the throttle grip causes rotation of the throttle shaft, which changes a throttle position of a throttle of the outboard motor. A rotation direction switching mechanism is manually position-able into a first position in which rotation of the throttle grip through the first range of motion controls the throttle of the outboard motor and alternately manually position-able into a second position in which rotation of the throttle grip through the second range of motion controls the throttle position.

U.S. Pat. No. 10,246,173 discloses a tiller is for an outboard motor and has a manually operable shift mechanism configured to actuate shift changes in a transmission of the outboard motor amongst a forward gear, reverse gear, and neutral gear. The tiller also has a manually operable throttle mechanism configured to position a throttle of an internal combustion engine of the outboard motor into and between the idle position and a wide-open throttle position. An interlock mechanism is configured to prevent a shift change in the transmission out of the neutral gear when the throttle is positioned in a non-idle position. The interlock mechanism is further configured to permit a shift change into the neutral gear regardless of where the throttle is positioned.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In non-limiting examples disclosed herein, a tiller is for controlling a marine drive. The tiller comprises a tiller arm, a base bracket assembly comprising a yaw bracket configured for fixed attachment to a marine drive and a steering bracket which pivotably couples the tiller arm to the yaw bracket for movement about a yaw axis, and a yaw lock configured to lock the steering bracket and tiller arm in a plurality of yaw positions relative to the yaw axis, wherein unlocking the yaw lock facilitates movement of the tiller arm into a new yaw position of the plurality of yaw positions.

In non-limiting examples disclosed herein, a hand grip is on an outer end of the tiller arm, the hand grip being rotatable relative to the tiller arm so as to control a speed of the marine drive. A shaft in the tiller arm is coupled to the hand grip such that rotation of the hand grip causes rotation of the shaft. A grip restraining device configured to restrain rotation of the shaft and thus rotation of the hand grip. The grip restraining device is located on a bottom of the tiller arm and is accessible from opposite sides of the tiller arm for ambidextrous operation.

In non-limiting examples disclosed herein, the tiller arm is coupled to the base bracket assembly such that it is pivotable about a tilt axis relative to the base bracket assembly. A tilt mechanism comprises a tilt bracket coupled to one of the base bracket assembly or the tiller arm and a pawl coupled to the other one of the base bracket assembly or tiller arm. The tilt mechanism is movable into an engaged position in which the pawl engages the tilt bracket to retain the tiller arm in a selected one of a range of tilt positions relative to the base bracket assembly, and into a disengaged position in which the pawl is disengaged from the tilt bracket such that the tiller arm is freely pivotable about the tilt axis relative to the base bracket assembly. The range of tilt positions comprises a downward tilt position in which the tiller arm is angled downwardly relative to horizontal so as to facilitate carrying of the marine drive via the tiller arm.

BRIEF DESCRIPTION OF THE DRAWINGS

Embodiments are described with reference to the following drawing figures. The same numbers are used throughout to reference like features and components.

DETAILED DESCRIPTION

Figure 1:
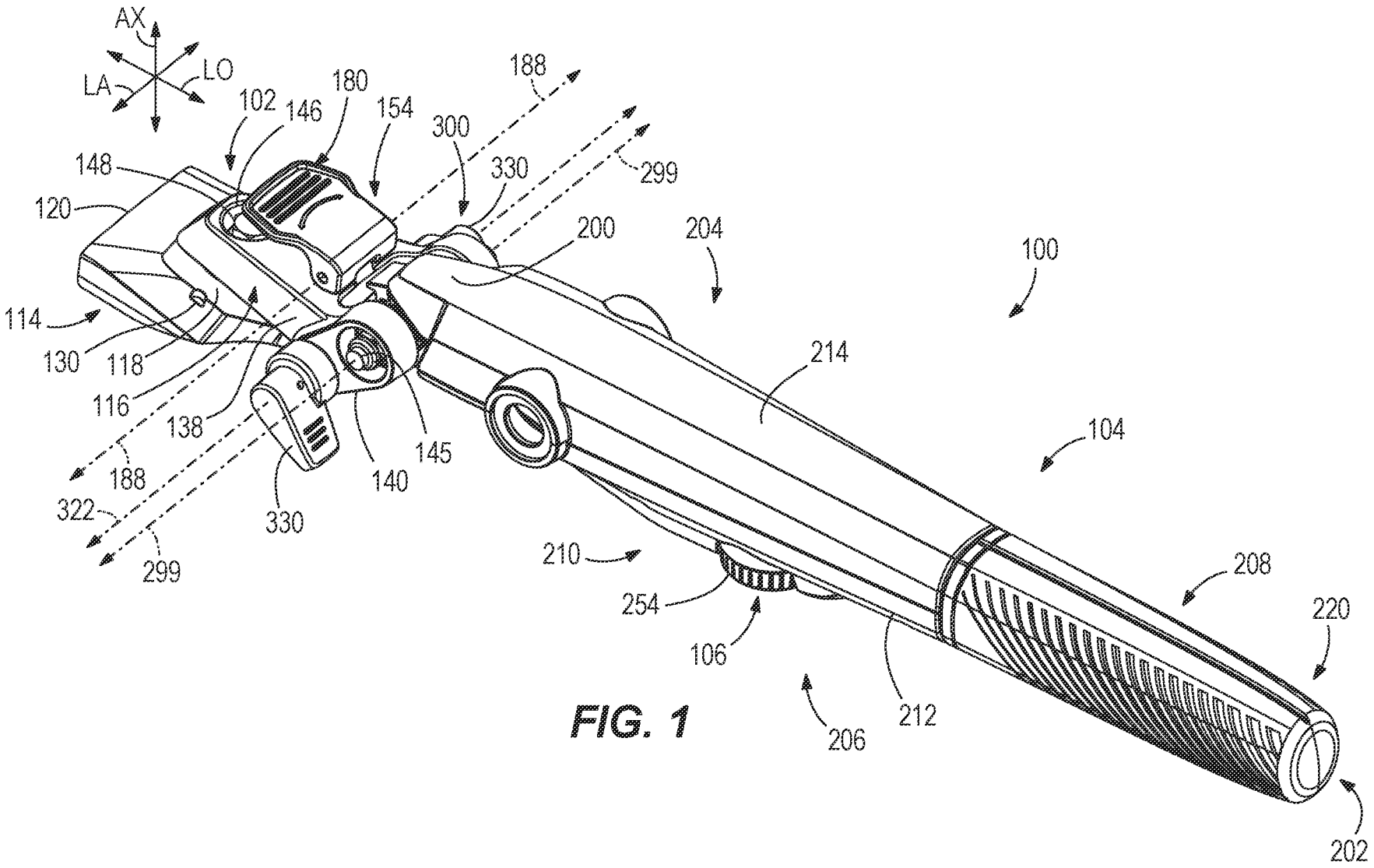
FIG. 1 is a perspective view looking down at a tiller according to the present disclosure.

FIG. 1 illustrates a tiller 100 for controlling a not shown marine drive, such as an outboard motor. In general, the tiller 100 has a base bracket assembly 102 and a tiller arm 104 which is coupled to and extends outwardly from the base bracket assembly 102. The tiller 100 has several novel attributes which will be further explained herein below. Briefly, the base bracket assembly 102 is specially configured to facilitate yaw adjustment of the tiller arm 104, in particular into and between a variety of yaw positions relative to the marine drive. In addition, the tiller arm 104 has a novel grip restraining device 106 which is located on the bottom of the middle portion of the tiller arm 104 and is manually accessible from both sides of the tiller arm 104 for ambidextrous use. The grip restraining device 106 is specially configured to selectively restrain rotation of a hand grip 220 on the outer end of the tiller arm 104. In addition, the tiller arm 104 has a tilt mechanism 300 which facilitates tilting of the tiller arm 104 relative to the base bracket assembly 102 into and between a variety of tilt positions, including a straight upwardly extending tilt position and a straight downwardly extending tilt position (see FIG. 15) for manual carrying of the marine drive via the tiller arm 104.

Referring to FIGS. 2-6, the base bracket assembly 102 includes a yaw bracket 114 and a steering bracket 116. The yaw bracket 114 is a rigid member having a body 118 and a base 120 which extends from the body 118 and is configured for fixed mounting to a not-shown steering arm of the marine drive, by for example fasteners extending through holes 122 (see FIG. 6) in the end of the base 120. The body 118 of the yaw bracket 114 provides a pedestal 124. A through-bore 126 (FIG. 4) extends through the center portion of the pedestal 124. Three engagement recesses 128 extend into the pedestal 124. Each engagement recess 128 has a drain hole 129 (FIG. 3) which drains fluid that may accumulate in the engagement recess 128 during normal use. The three engagement recesses 128 are spaced apart fifteen degrees relative to the through-bore 126. Opposing partial recesses 130 (FIG. 4) are formed in the opposing sidewalls of the body 118 and are located one-hundred-and-eighty degrees apart from each other relative to the center of the through-bore 126. The center-most of the engagement recesses 128 is located ninety degrees apart from each of the partial recesses 130, respectively, relative to the center of the through-bore 126. The engagement recesses 128 and partial recesses 130 together span one-hundred-and-eighty degrees relative to the center of the through-bore 126. A washer 132 is seated in an annular cavity 136 extending about the through-bore 126.

The steering bracket 116 is a rigid member having a body 138 and a pair of upwardly angled arms 140 having opposed lower through-bores 142 through the lower ends of the arms 140 and opposed through-bores 144 through the upper ends of arms 140. A fastener 145 extends through the opposed through-bores 144 and through a corresponding through-bore 147 (FIG. 2) in the tiller arm 104 so as to couple the tiller arm 104 to the steering bracket 116 in a way that the tiller arm 104 is tiltable up and down relative to the steering bracket 116, as will be further described herein below.

A through-bore 146 (FIG. 4) extends through the body 138. A fastener 148 extends through the through-bore 146, through the washer 132 and through the through-bore 126 in the body 118 and into threaded engagement with a threaded bolt cap 151. The fastener 148 has a body 150 with a smooth outer surface, which is disposed in the through-bore 146, the washer 132 and the through-bore 126 when the fastener 148 is in its position of use. As such, the steering bracket 116 is rotatable in either direction relative to the yaw bracket 114 about the fastener 148. As explained above, the yaw bracket 114 is fixed to the steering arm of the marine drive and the steering bracket 116 is attached to the tiller arm 104. Thus, the tiller arm 104 and steering bracket 116 are pivotable together about the yaw axis 152 (FIG. 3) defined by the fastener 148 into and between a variety of yaw positions relative to the yaw bracket 114 and marine drive, as will be further described herein below.

Figure 3:
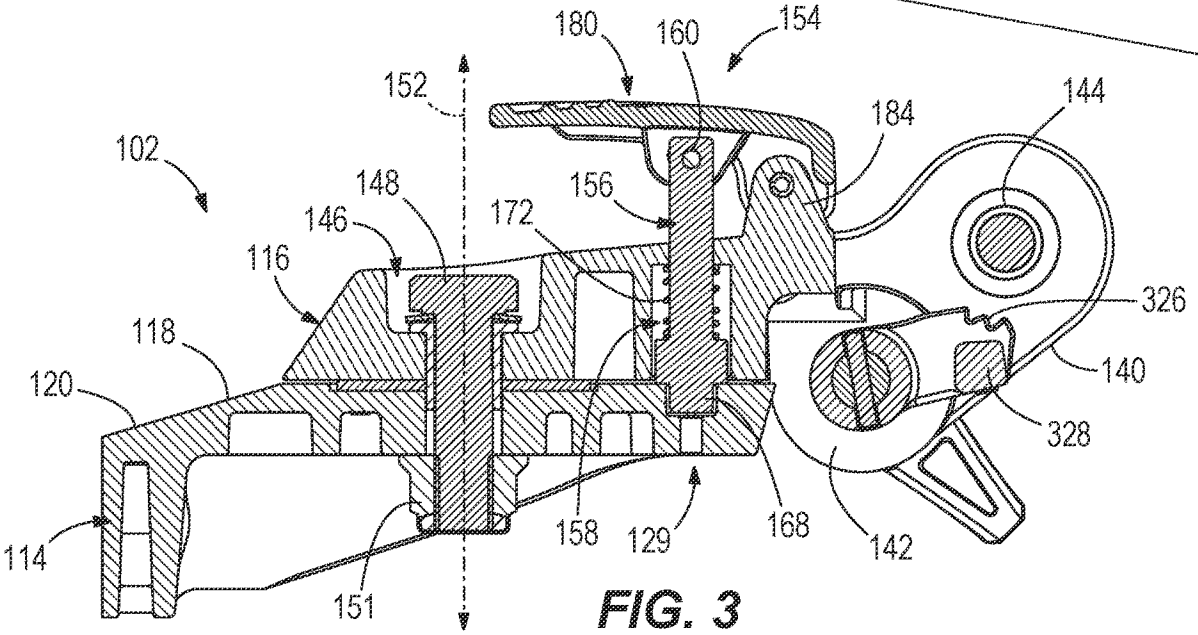
FIG. 3 is a section view of the base bracket assembly.
Figure 4:
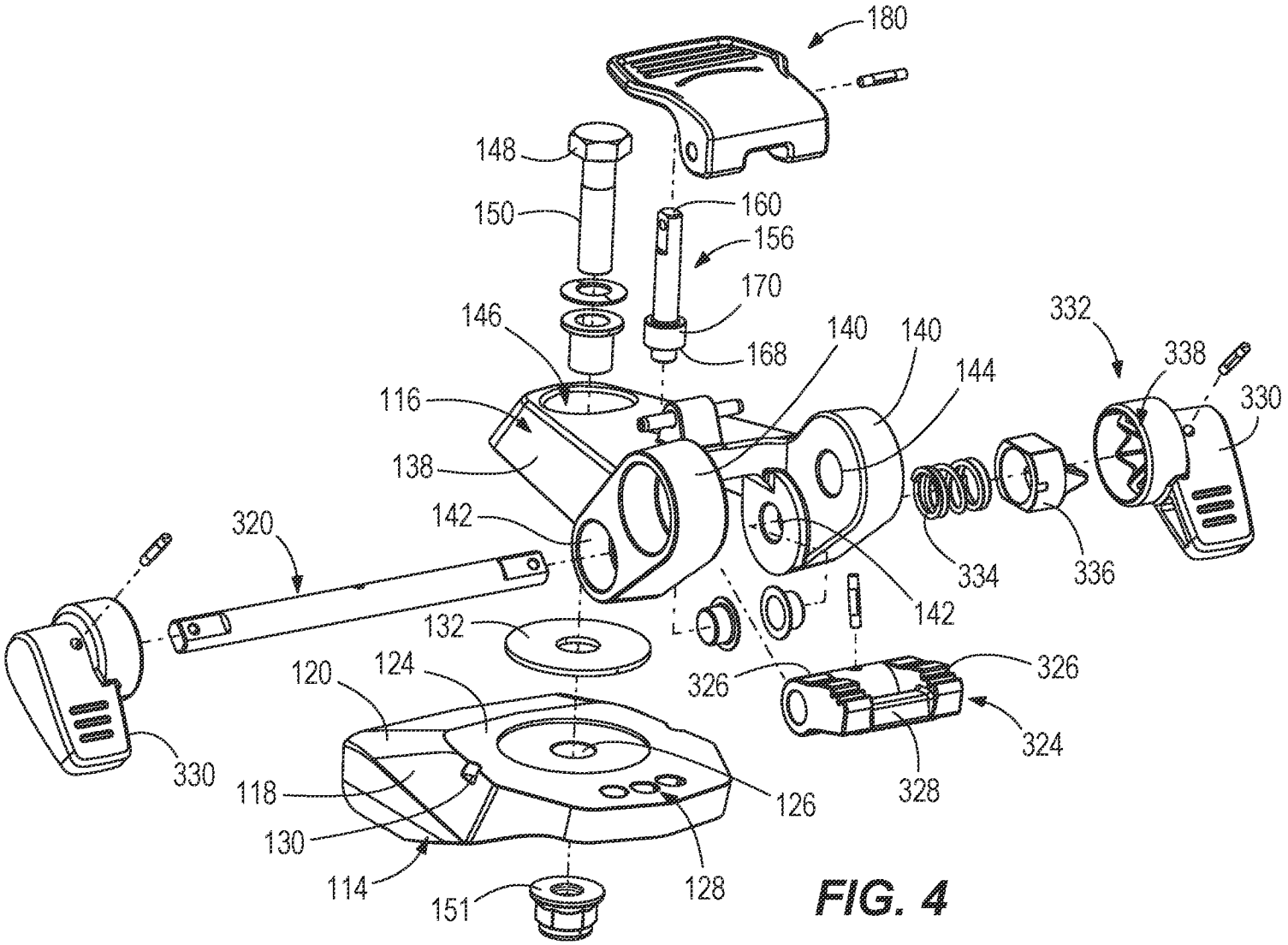
FIG. 4 is an exploded view of the base bracket assembly.
Figure 5:
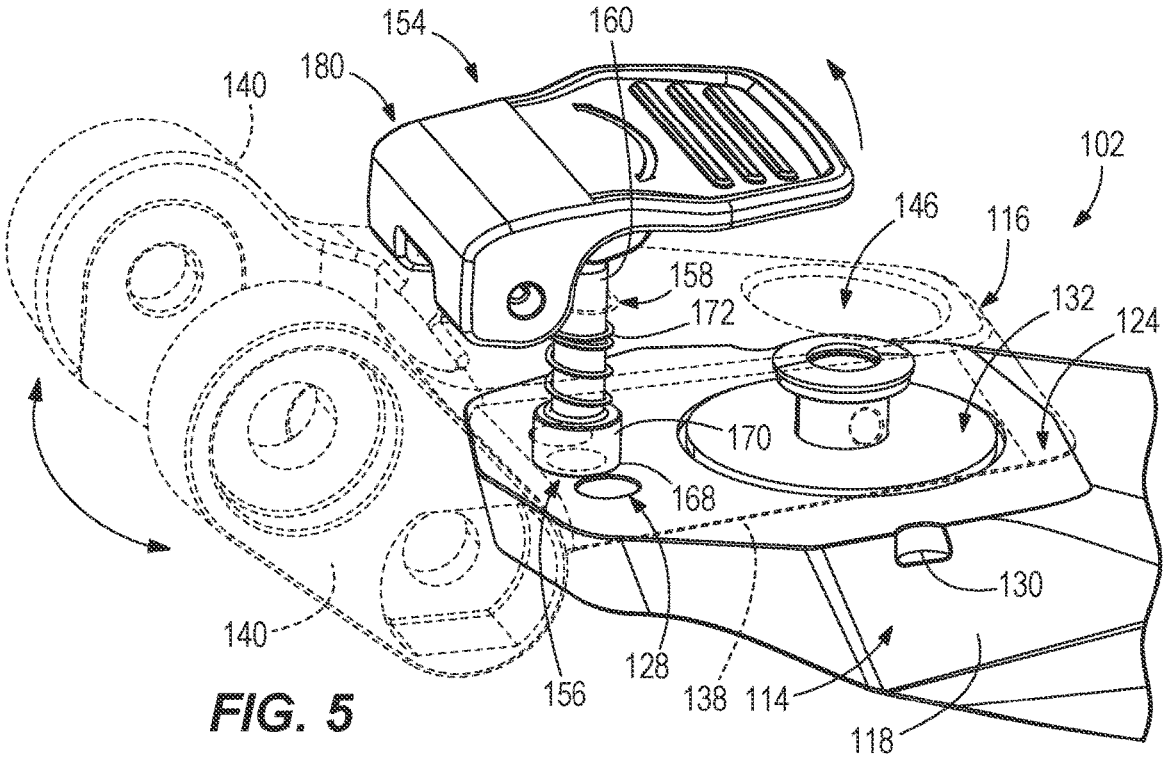
FIGS. 5 and 6 are perspective views, partially in phantom, illustrating a yaw lock.
Figure 6:
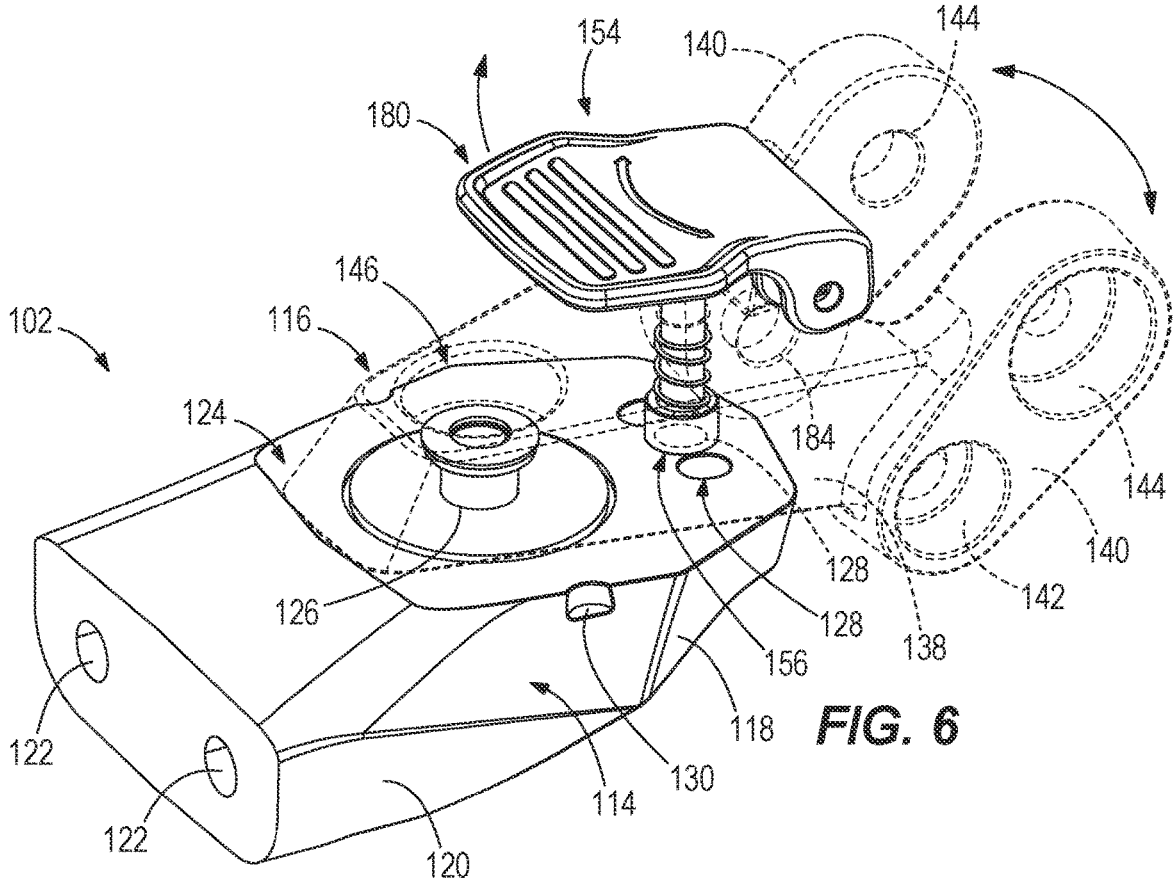
Figure 7:
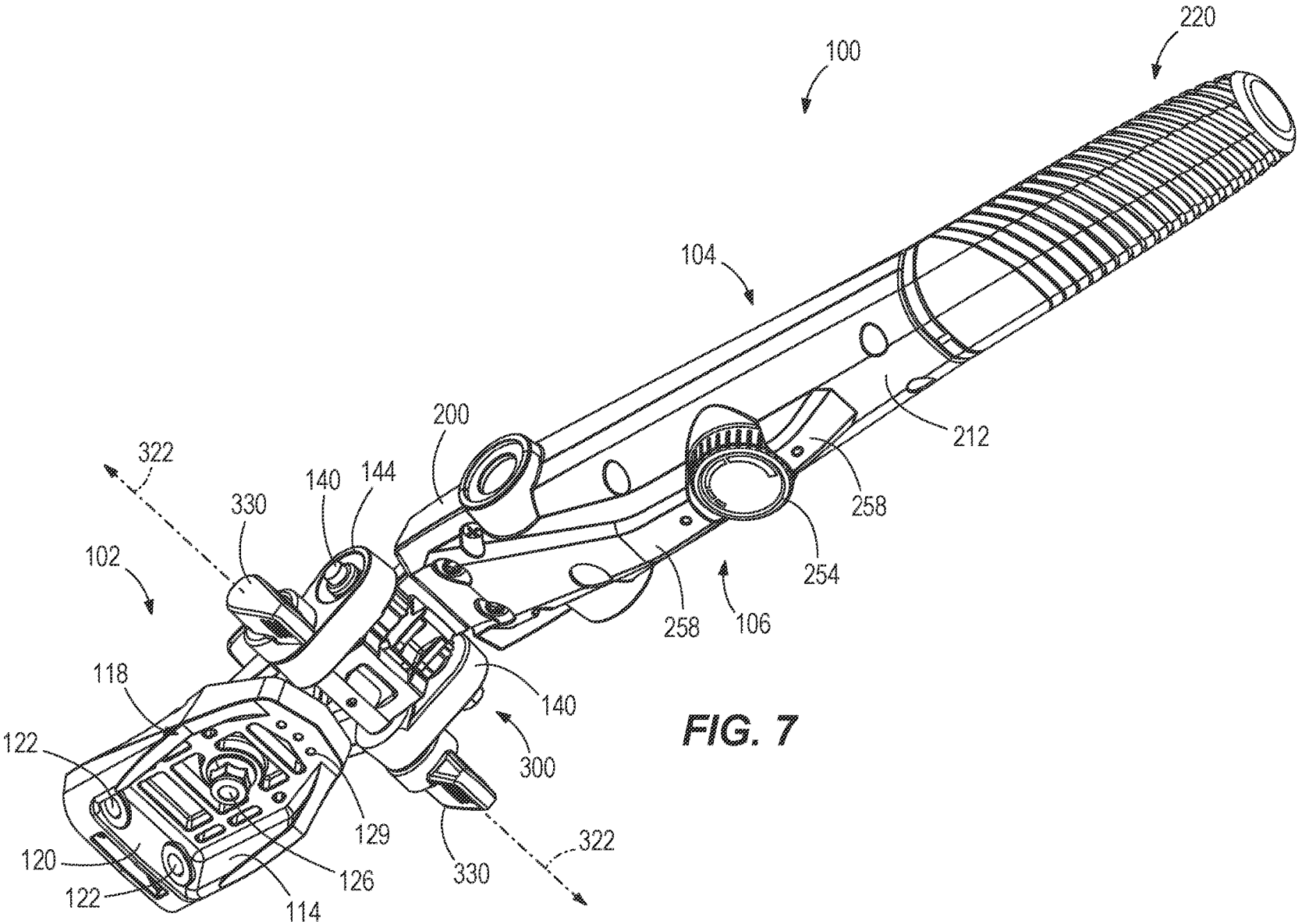
FIG. 7 is a perspective view looking up at the tiller arm.
Figure 8:
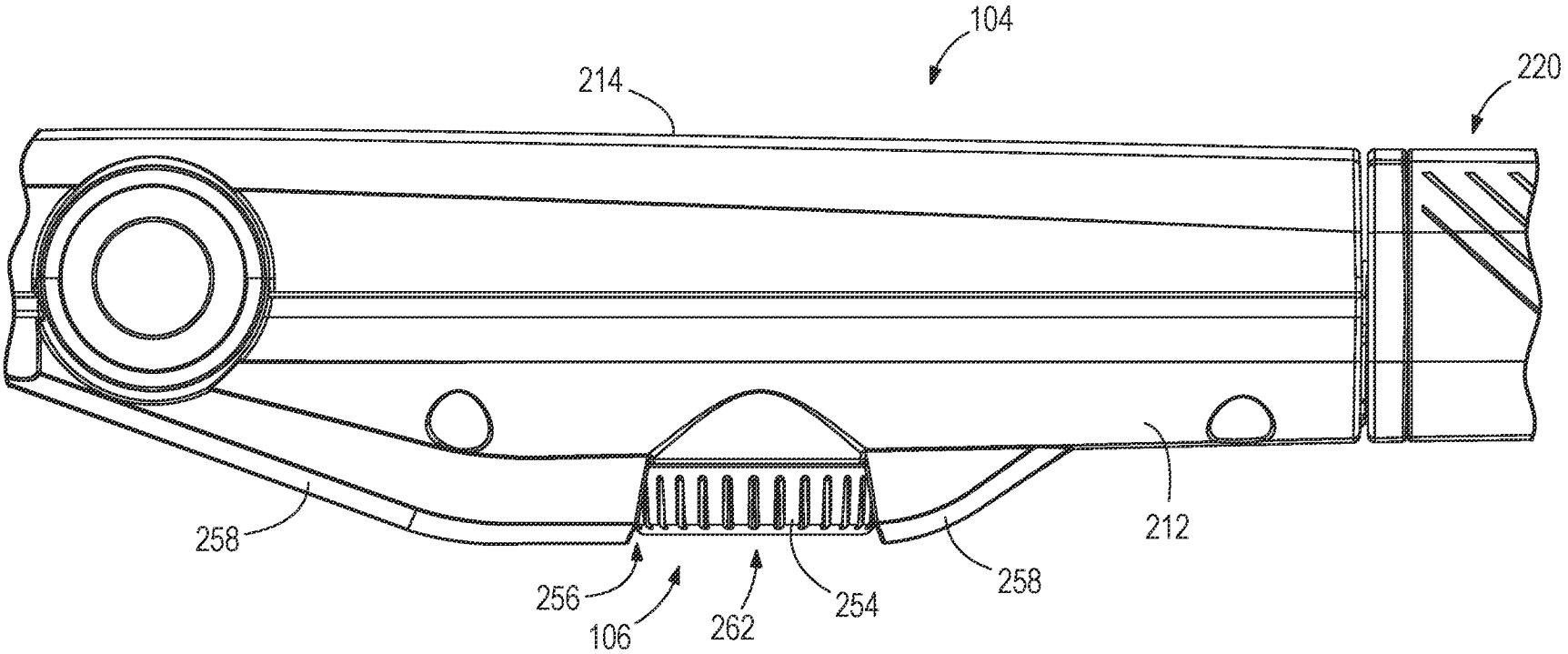
FIG. 8 is a side view of the tiller arm along the grip restraining device.

A yaw lock 154 (FIG. 5) is specially configured to lock the tiller arm 104 and steering bracket 116 in a variety of yaw positions relative to the yaw bracket 114 and marine drive, as shown by arrows in FIGS. 5 and 6. The yaw lock 154 includes a plunger 156 which resides in a through-bore 158 in the steering bracket 116 which defines an internal cavity and relatively smaller top and bottom openings in the body 138 of the steering bracket 116. Referring to FIGS. 3 and 4, the plunger 156 is an elongated member with a top end 160 which normally protrudes out of the top opening, a bottom end 168 which in a locked position protrudes out of the bottom opening, and a relatively enlarged annular body 170 which is trapped in the cavity because it is too big to pass through top and bottom openings. A coiled spring 172 is disposed between the top of the annular body 170 and the inside of the cavity adjacent to the top and normally biases the bottom end 168 of the plunger 156 outwardly relative to the bottom opening into the position shown in FIG. 3.

The yaw lock 154 also includes a release lever 180 located on top of the steering bracket 116 such that it is easily manually accessible from above and from the sides of the tiller 100. The release lever 180 has a first end which is pivotably coupled to mounting boss 184 protruding up from the top of the steering bracket 116, a second end which can be manually lifted by the operator's finger(s) to pivot the release lever 180 upwardly about the pivot axis defined through the mounting boss 184. The top end 160 of the plunger 156 protrudes out of the top opening and is pivotally coupled to the bottom of the middle portion of the release lever 180, between the first end and second end.

FIGS. 5 and 6 show the yaw lock 154 in a locked position wherein the bottom end 168 of the plunger 156 is biased by the spring 172 into the center-most engagement recess 128, which retains the steering bracket 116 in a straight-ahead position relative to the yaw bracket 114 and associated marine drive for straight-ahead steering. As shown by arrows in FIGS. 5 and 6, to change the yaw position of the tiller 100 relative to the marine drive, the user manually pivots the first end of the release lever 180 upwardly relative to the mounting boss 184, which pulls upwardly on the plunger 156 and causes the annular body 170 to compress the coiled spring 172. As this occurs, the second end of the plunger 156 is removed from the yaw bracket 114, which frees the steering bracket 116 and tiller arm 104 for pivoting motion about the yaw axis 152 (FIG. 3) relative to the yaw bracket 114 and marine drive. As discussed above, in the illustrated embodiment, the steering bracket 116 is pivotable through at least one-hundred-and-eighty degrees relative to the yaw bracket 114 and lockable in each of the yaw positions designated by the engagement recesses 128, 130. Particularly, the user can release the release lever 180, which permits the spring 172 to bias the second end of the plunger 156 outwardly towards and into engagement with the pedestal 124. Once the plunger 156 becomes aligned with a next of the engagement recesses 128, 130, the spring 172 will bias the bottom end 168 of the plunger 156 into the engagement recess 128, 130.

As such, it will be understood that unlocking the yaw lock 154 advantageously facilitates movement of the tiller arm 104 into a new yaw position relative to the marine drive. In the non-limiting illustrated embodiment, the tiller arm 104 and steering bracket 116 are pivotable through one-hundred-and-eighty degrees relative to the yaw bracket 114. It will also be understood that the yaw lock 154 is advantageously configured such that upon movement of the tiller arm 104 and steering bracket 116 into the new yaw position, the yaw lock 154 automatically locks the tiller arm 104 and steering bracket 116 in the new yaw position via engagement of the spring-loaded plunger 156 with another engagement recess 128, 130 of the plurality of recesses.

Referring to FIG. 1, the tiller arm 104 extends from an inner end 200 to an outer end 202 in a longitudinal direction LO, from top 204 to bottom 206 in an axial direction AX which is perpendicular to the longitudinal direction LO, and from a first side 208 to a second side 210 which is opposite the first side 208 in a lateral direction LA which is perpendicular to the longitudinal direction LO and perpendicular to the axial direction AX.

Figure 9:
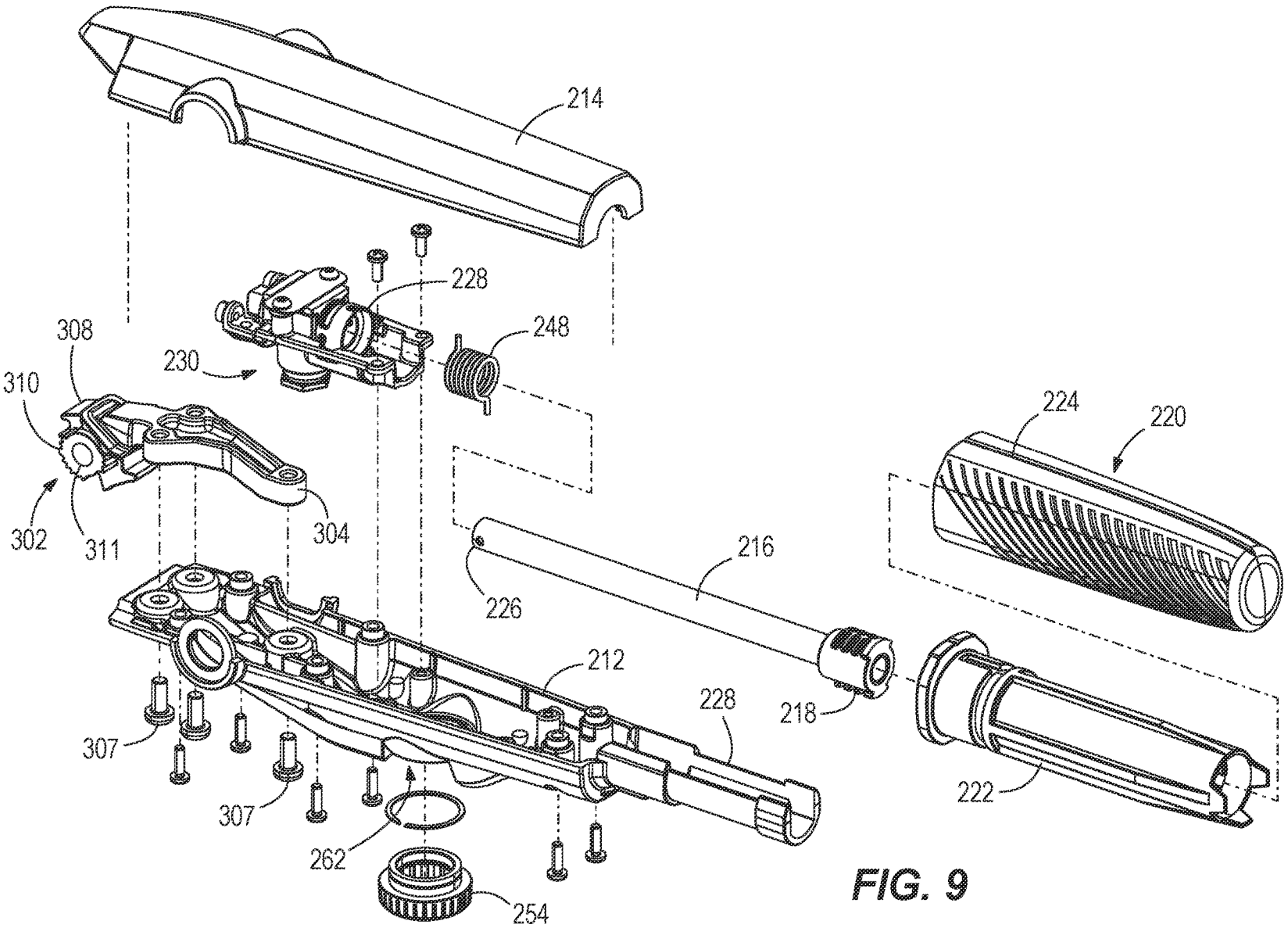
FIG. 9 is an exploded view illustrating the tiller arm.
Figure 10:
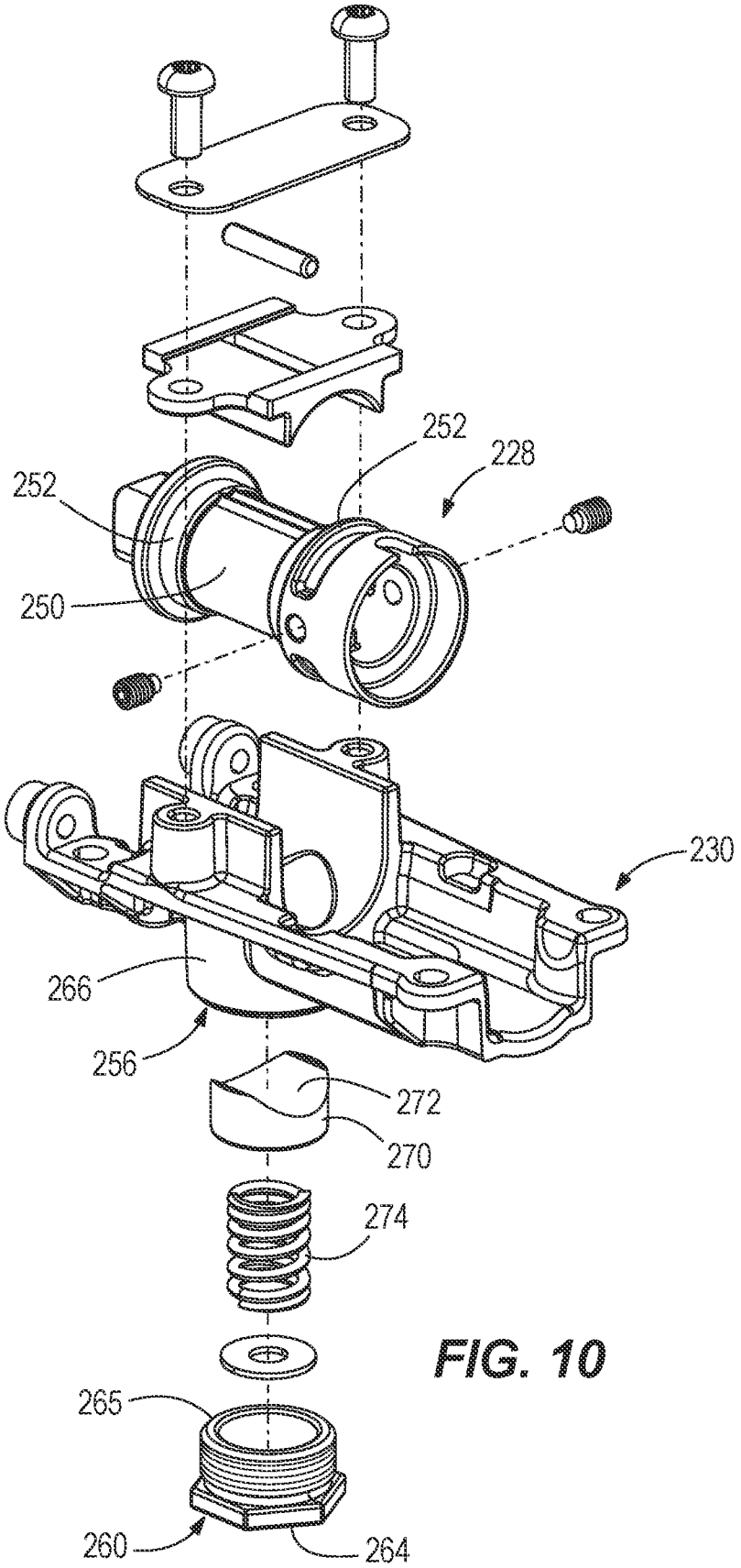
FIG. 10 is an exploded view illustrating the grip restraining device.

Referring to FIG. 1, tiller arm 104 has a chassis 212 which is elongated in the longitudinal direction LO and underlies and supports various components associated with the tiller arm 104. A cover 214 is mounted on top of chassis 212 and encloses the various components in an interior of the tiller arm 104. Referring to FIG. 9, a shaft 216 protrudes from the interior via a passage defined between the front of the chassis 212 and cover 214. The shaft 216 is rotatable about its own axis and has a front end 218 which is coupled to a hand grip 220. The hand grip 220 includes a grip member 222 and a grooved grip cover 224. The shaft 216 is coupled to the hand grip 220 such that manually rotating the hand grip 220 relative to the chassis 212 and cover 214 causes rotation of the shaft 216 relative to the chassis 212 and cover 214. The shaft 216 has a rear end 226 which includes a shaft extension 228 located within a supporting tray 230. A magnetic sensor 252 is mounted to the supporting tray 230 and is configured to sense rotation of the shaft 216 (via the shaft extension 228) and communicate such sensed rotation to a controller for the associated marine drive. Sensing arrangements for sensing rotation of a shaft in a tiller arm are conventional and well known in this art and thus not further herein described. As such, it will be understood that rotation of the hand grip 220 causes rotation of the shaft 216, including shaft extension 228 within the supporting tray 230 and such rotation in turn causes change in the speed of the marine drive.

Figure 11:
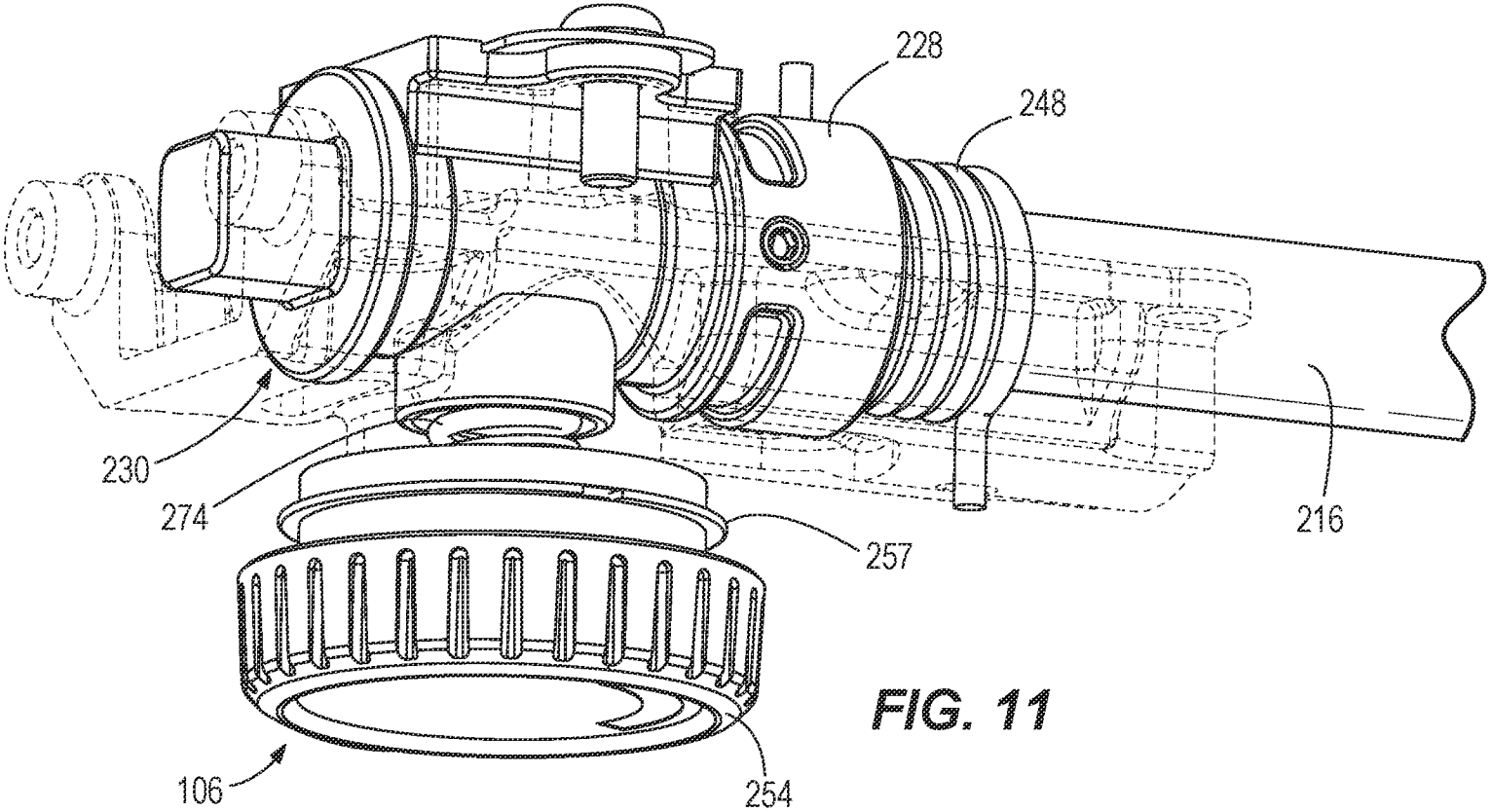
FIG. 11 is a perspective view, partially in phantom, illustrating the grip restraining device.
Figure 12:
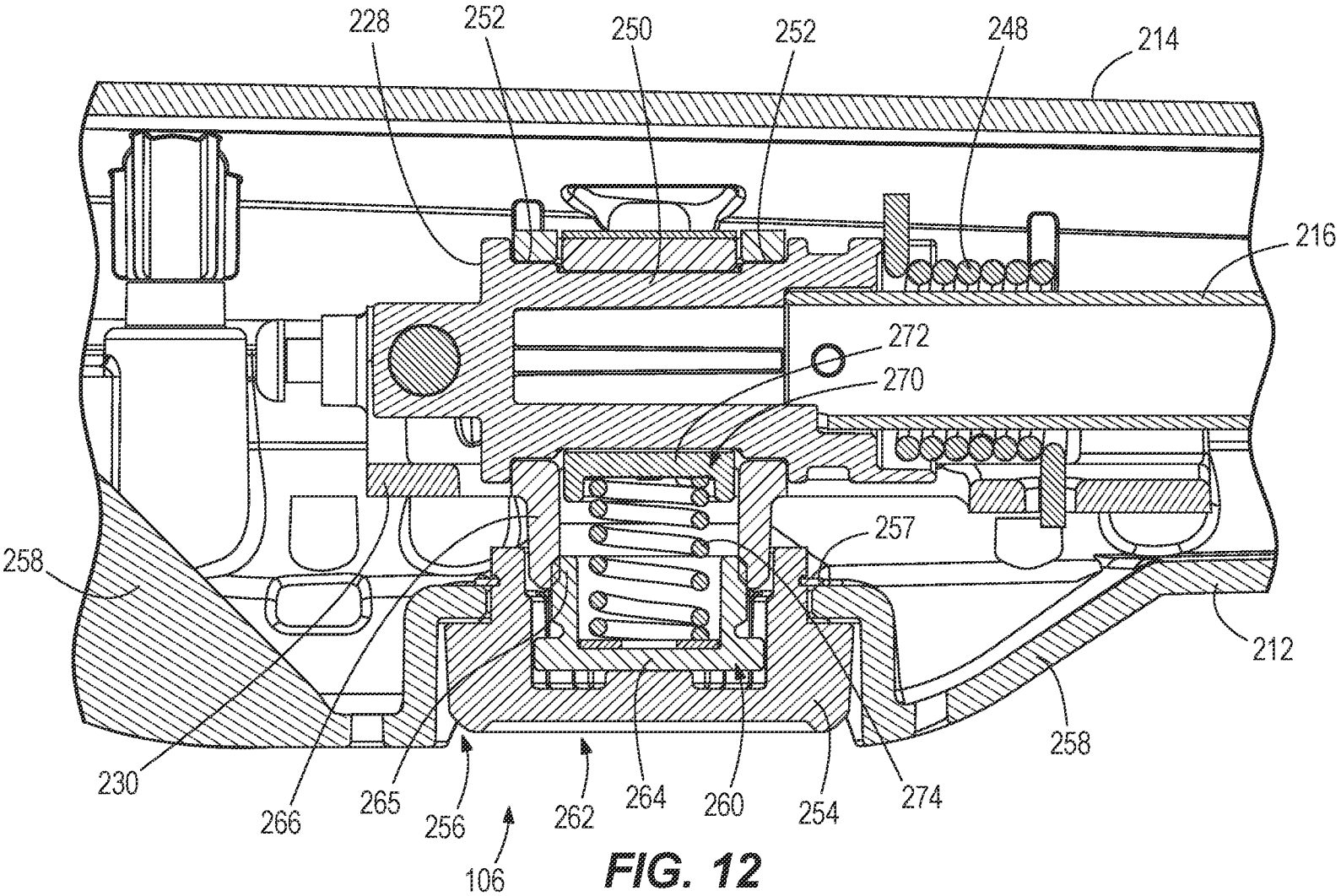
FIG. 12 is a section side view of the grip restraining device.
Figure 13:
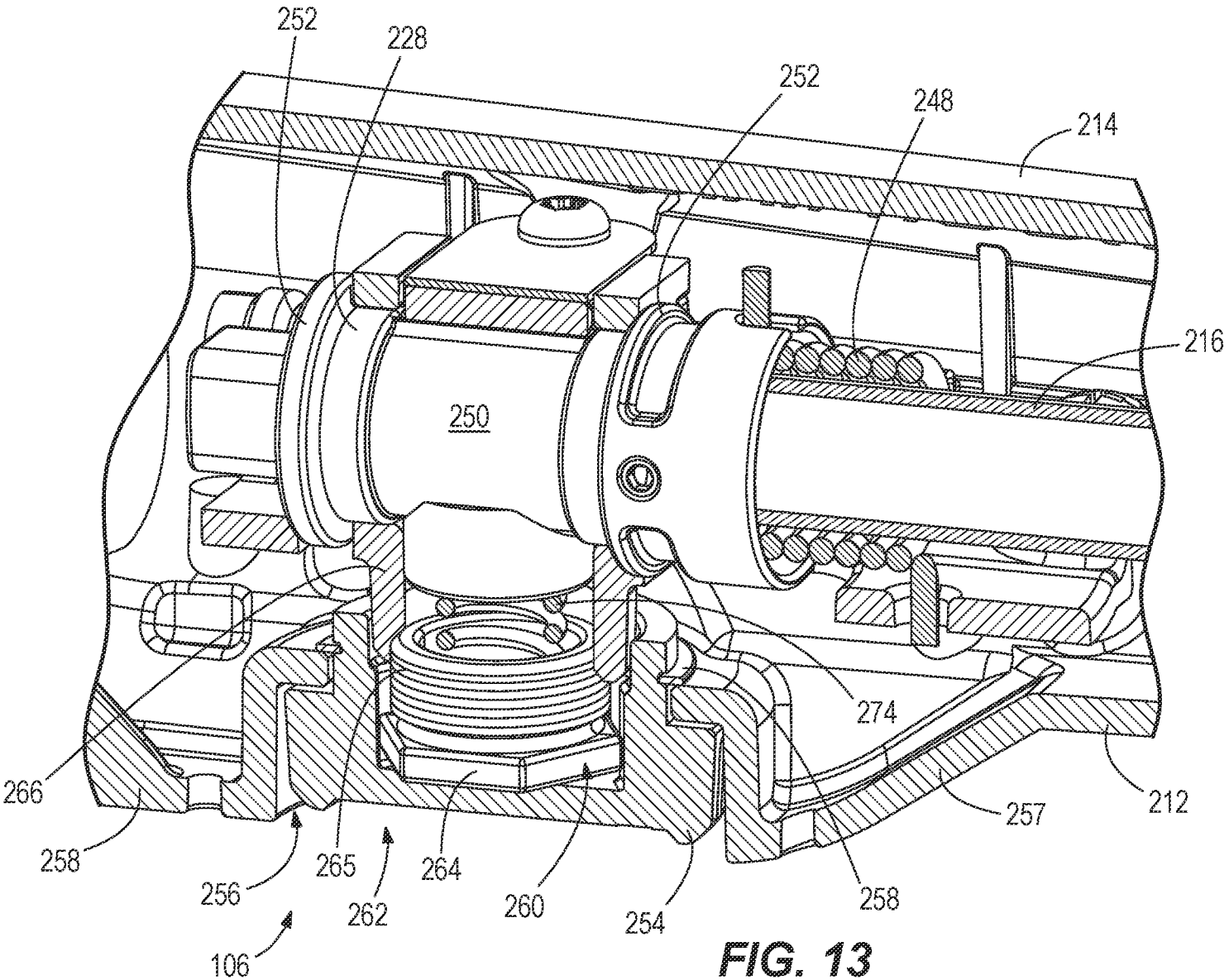
FIG. 13 is a perspective view of the grip restraining device.
Figure 14:
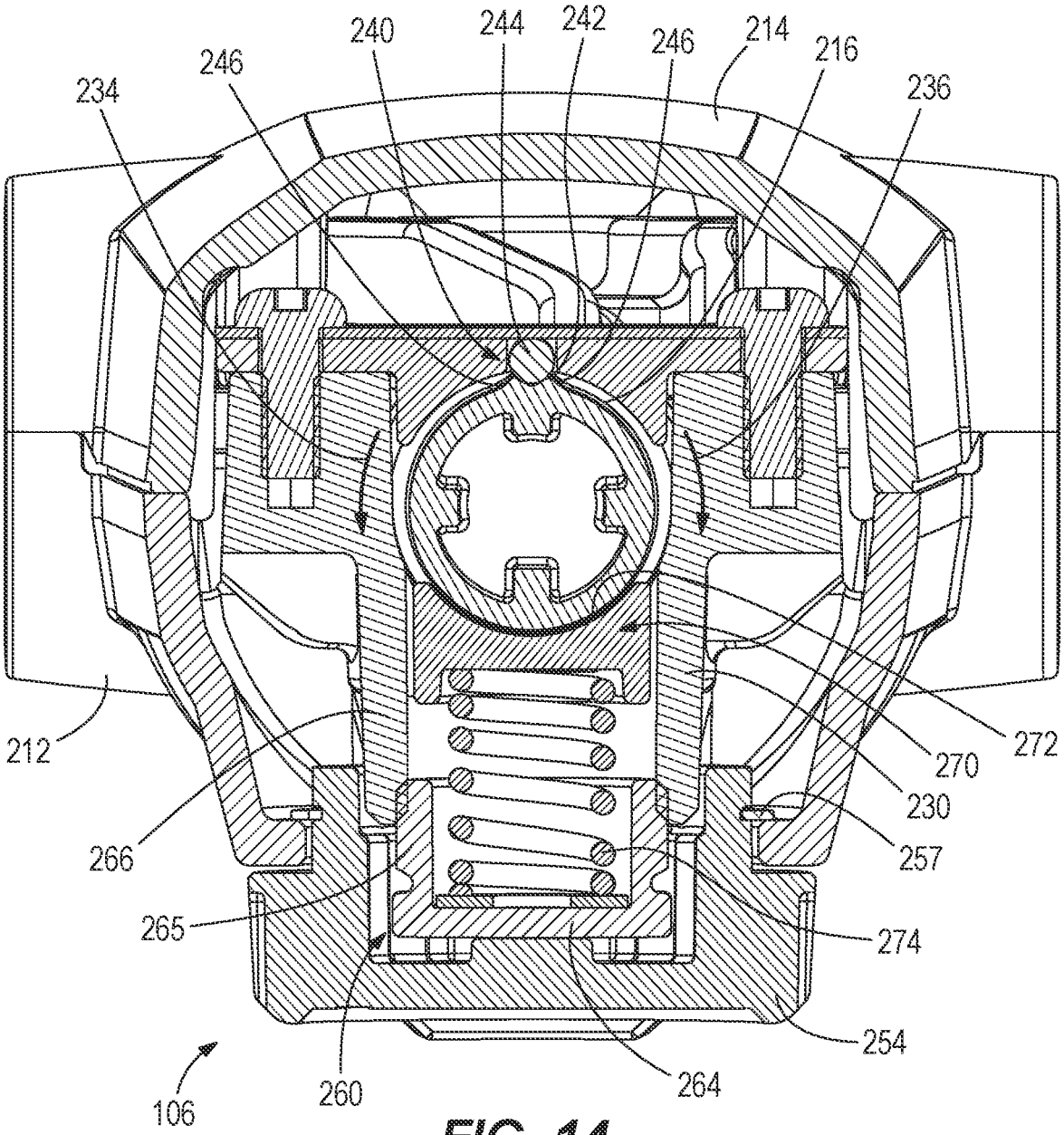
FIG. 14 is a sectional end view illustrating the grip restraining device.

Referring to FIG. 14, the hand grip 220 and shaft 216, including shaft extension 228, are rotatable in opposite directions away from the center position shown and thus is configured for ambidextrous use. That is, the hand grip 220 can be rotated in the direction of arrow 234 to increase the speed of the marine drive and alternately the hand grip 220 can be rotated in the direction of arrow 236 to increase the speed of the marine drive, a detent mechanism 240 provides tactile feedback to the user grasping the hand grip 220 when the hand grip 220 is rotated into the center position shown, which corresponds to neutral position for the marine drive. The detent mechanism 240 includes a raised groove 242 on the top of the outer diameter of the shaft extension 228 and a roller pin 244 which is coupled to the supporting tray 230 and which becomes aligned with and pops into the raised groove 242 when the hand grip 220 and shaft 216 are rotated into the center position. Seating of the roller pin 244 provides tactile feedback in the form of a click which can be felt by the user grasping the hand grip 220. Smoothly contoured surfaces 246 provide ramps on opposite sides of the raised groove 242 leading up to the groove and thus provide a gradually increasing resistance to the user rotating the hand grip 220 towards the center position until the roller pin 244 becomes aligned with and seats in the raised groove 242. Referring to FIGS. 11-13, in the illustrated example a coiled torsion spring 248 is disposed on the shaft 216 and has a first end attached to the shaft 216 and an opposite, second end attached to the supporting tray 230. In other examples, the coiled torsion spring 248 can include one of two or more springs having opposite winding. The torsion spring 248 rotationally biases the shaft 216 towards the center position shown in FIG. 14, however the bias force provided by the torsion spring 248 is not great enough to overcome the engagement force between the roller pin 244 and the ramped surfaces 246. Instead, it is necessary to apply manual rotational force on the shaft 216 via the hand grip 220 to bring the raised groove 242 into alignment with the roller pin 244. As such, it will be understood that manually grasping and rotating the hand grip 220 away from the center position in either direction 234, 236 increases the speed of the marine drive. Manually releasing the hand grip 220 permits the bias of the torsion spring 248 to rotate the shaft 216 and hand grip 220 back towards the center position until the respective ramped surface 246 engages the roller pin 244. To fully move the hand grip 220 back to the center position, the user must grasp and rotate the hand grip 220 with a force needed to push the ramped surface 246 past the roller pin 244 so that the roller pin 244 will pop into place in the raised groove 242.

Referring to FIGS. 11-14, the grip restraining device 106 is specially configured to restrain rotation of the shaft 216 and thus rotation of the hand grip 220. This is useful when the user wants to maintain a certain speed of the marine drive without having to continuously hold the hand grip 220. This is also useful when the user wants to vary the amount of resistance which the hand grip 220 provides to rotational force. Some users prefer a hand grip which is more difficult to rotate. Others prefer a hand grip which is easier to rotate. The grip restraining device 106 advantageously allow the user to selectively vary and set the resistance.

The grip restraining device 106 restrains rotation of the hand grip 220 by frictionally engaging the outer diameter of the shaft extension 228 of the shaft 216. The shaft extension 228 is a generally cylindrical member having a groove 250 extending around its outer diameter. The groove 250 has flanges 252 which are retained in axial position by supporting surfaces of the supporting tray 230. The grip restraining device 106 generally includes a dial 254 which is mounted to a hole 256 in the bottom of middle portion of the chassis 212 of the tiller arm 104. A snap ring 257 mounts the upper portion of the dial 254 to the chassis 212 such that the dial 254 is freely rotatable relative to the chassis 212. Opposed ramped bottom walls 258 extend from the bottom of the chassis 212 and define a protective recess in which the dial 254 resides. Side cutouts 262 are defined in each of the bottom walls 258 and expose the outer diameter of the dial 254 on both first and second sides 208, 210 of the tiller arm 104.

The grip restraining device 106 further includes a shuttle 260 which is disposed in the dial 254, The shuttle 260 has an end 264 which is coupled to the interior of the dial 254 by flats such that rotation of the dial 254 causes rotation of the shuttle 260. The shuttle 260 has an opposite narrower end 265 which extends into and is engaged with the inner diameter of a boss 266 protruding downwardly from the supporting tray 230 by a threaded connection. As such, the shuttle 260 is coupled to the dial 254 and to the boss 266 in the supporting tray 230 such that rotation of the dial 254 in a first direction causes rotation of the shuttle 260 in the first direction, which causes the shuttle 260 to travel axially upwardly further into the boss 266 and towards the shaft extension 228. Rotation of the dial 254 in an opposite, second direction causes rotation of the shuttle 260 in the second direction, which causes the shuttle 260 to travel axially downwardly, outwardly relative to the boss 266, further away from the shaft extension 228.

The grip restraining device 106 further includes a friction plunger 270 which resides within the boss 266. The plunger 270 has an outer friction surface 272 which is curved to match and abut the curved outer diameter of the groove 250 of the shaft extension 228. A coiled spring 274 has a first end abutting the interior of the shuttle 260 and a second end abutting the inner surface of the friction plunger 270. The spring 274 tends to bias the friction plunger 270 away from the shuttle 260 and into frictional engagement with the groove 250 of the shaft extension 228.

As such, it will be understood that rotation of the dial 254 in a first rotational direction causes the shuttle 260 to axially move towards the shaft extension 228, which compresses the spring 274 and increases the force of which the friction plunger 270 frictionally engages with the shaft extension 228. This increases the restraining force or resistance to manual rotation of the hand grip 220. Rotation of the dial 254 in the opposite, second rotational direction causes the shuttle 260 to axially move away from the shaft extension 228, which allows the spring 274 to relax and decreases the force of which the friction plunger 270 engages with the shaft extension 228. This decreases the restraining force or resistance to manual rotation of the hand grip 220. Advantageously, the grip restraining device 106 is manually operable from either side 108, 110 of the tiller arm 104 and thus is configured for ambidextrous use. This is particularly advantageous in the illustrated embodiment wherein the hand grip 220 is rotatable relative to the tiller arm 104 through at least one-hundred-and-eighty degrees, including 90 degrees away from the center position in the first rotational direction (for right-handed use of the tiller 100), and 90 degrees away from the center position in the opposite, second direction (for left-handed use of the tiller 100).

Figure 2:
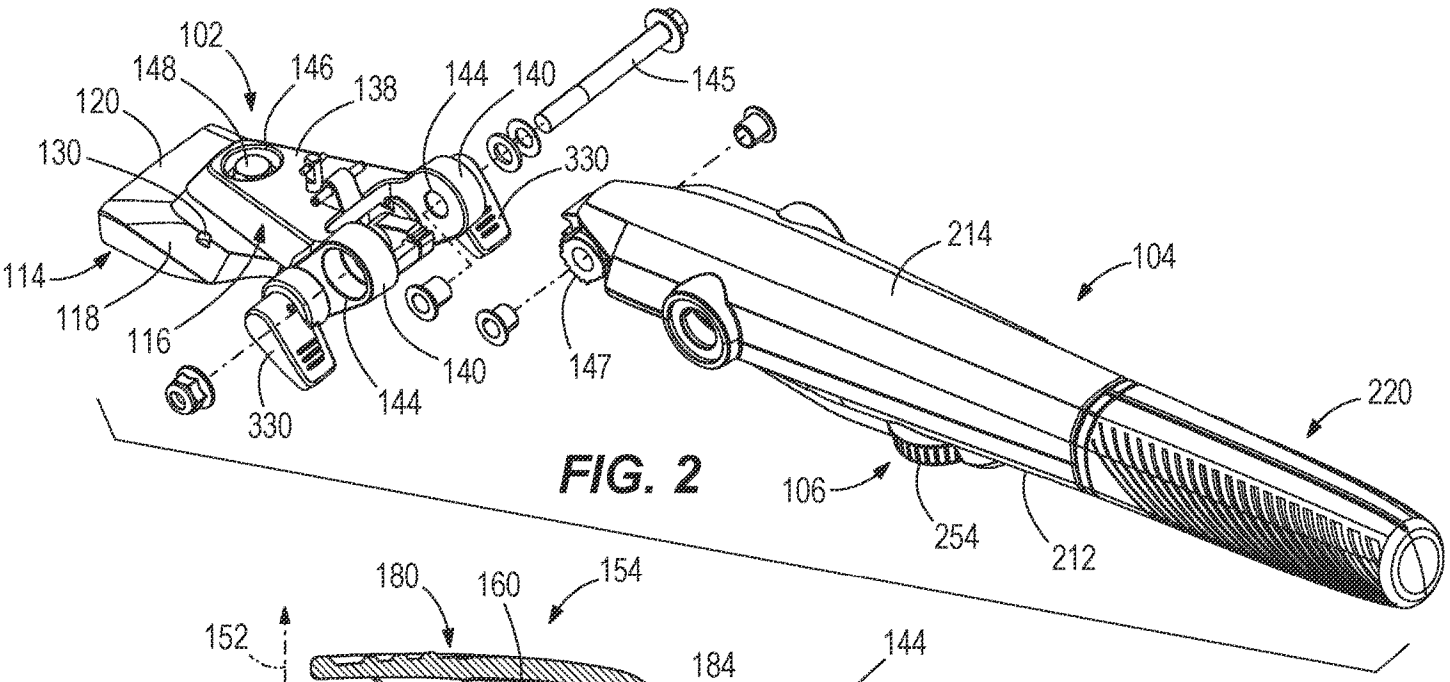
FIG. 2 is an exploded view of the tiller, illustrating a tiller arm including a chassis, a cover and a hand grip, spaced apart from a base bracket assembly comprising a yaw bracket and a steering bracket.

As described herein above with reference to FIGS. 1 and 2, the tiller 100 is pivotable relative to the base bracket assembly 102 via connection between the fastener 145 which extends through a through-bore 147 in the tiller arm 104, through the opposed through-bores 144 in the arms 140. The fastener 145 defines a tilt axis 299 about which the tiller arm 104 is pivotable relative to the base bracket assembly 102.

Figure 15:
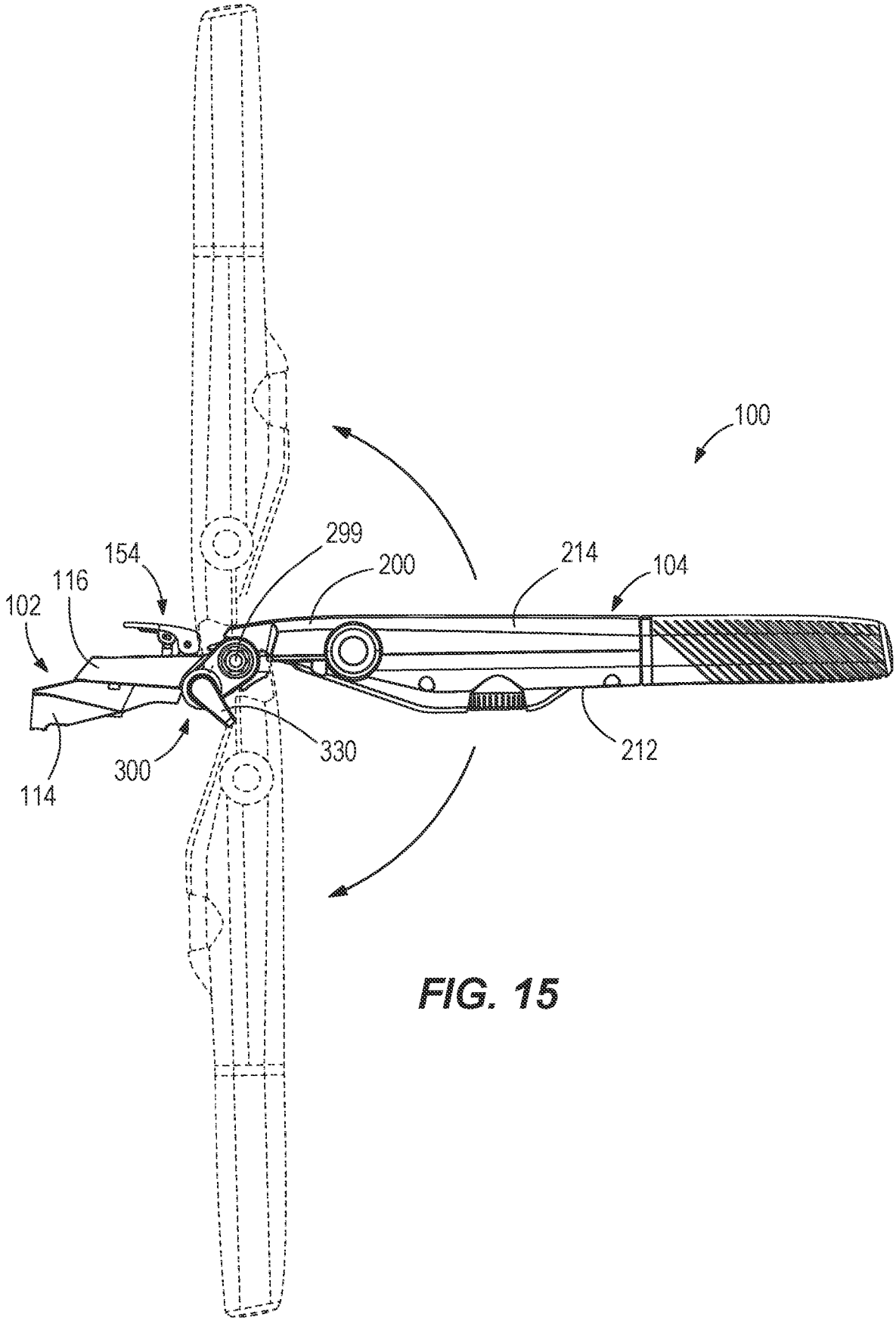
FIG. 15 is a side view illustrating the base bracket assembly and tiller arm, with the tiller arm shown in phantom line in a vertically straight up tilt position and in a vertically straight down tilt position.
Figure 16:
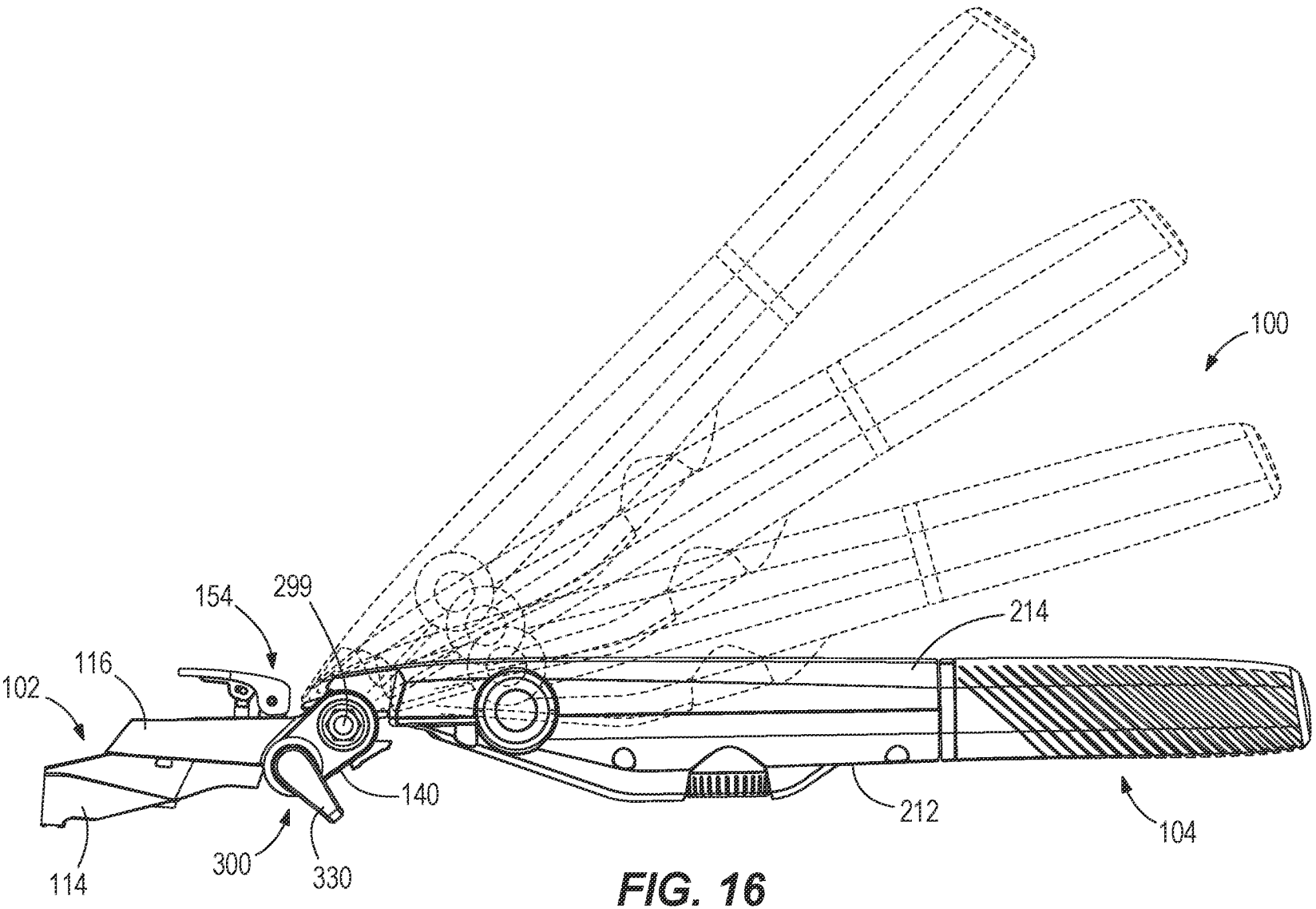
FIG. 16 is a side view illustrating the base bracket assembly and tiller arm, with the tiller arm shown in phantom line in a range of tilt positions.
Figure 17:
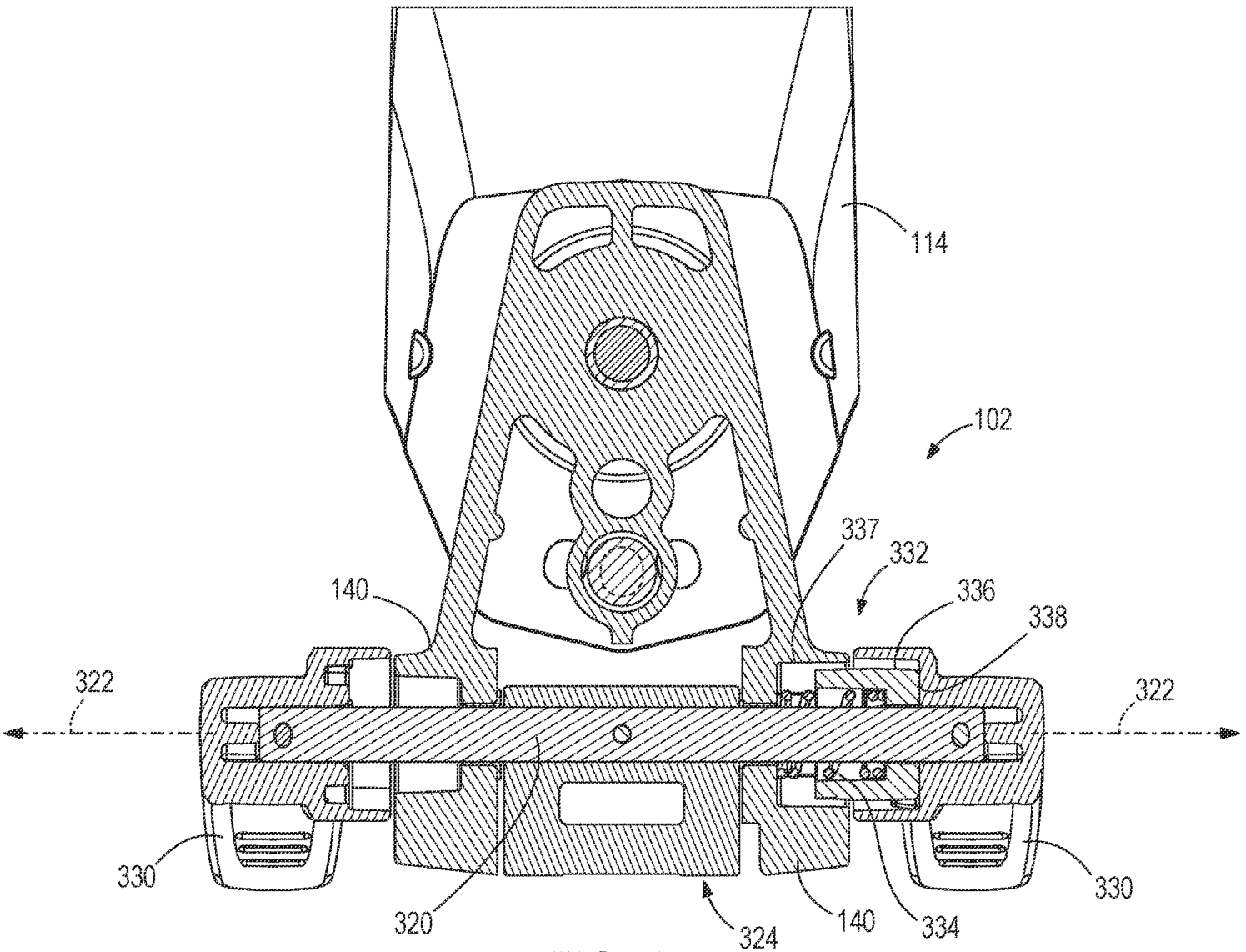
FIG. 17 is a sectional view of the tiller illustrating portions of a tilt mechanism for the tiller, including a tilt shaft, tilt levers, and a cam device.
Figure 18:
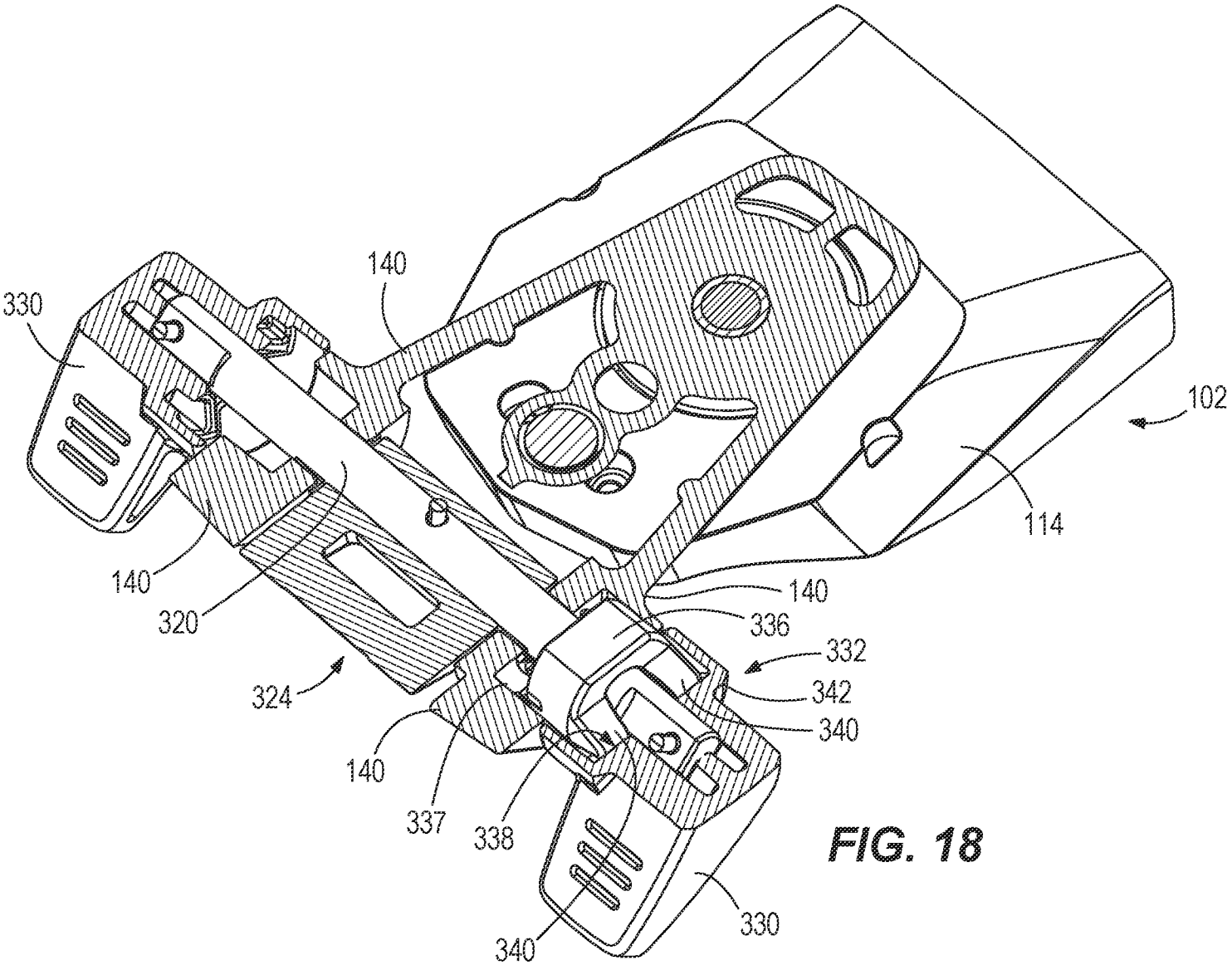
FIG. 18 is a view like FIG. 17, taken from a different perspective.
Figure 19:
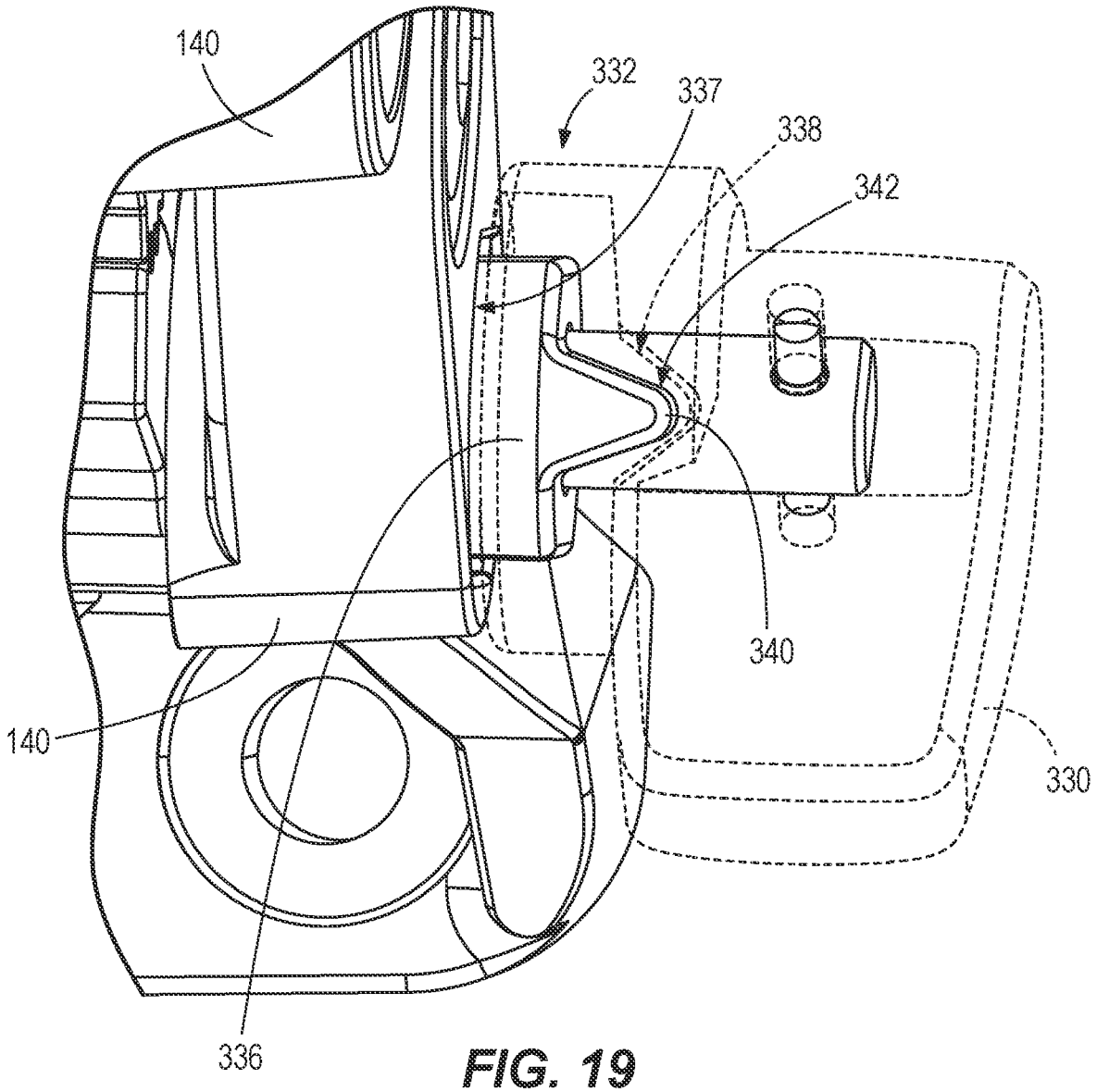
FIG. 19 is a view of one of the tilt levers shown in phantom and the cam device therein.

Referring to FIGS. 15 and 16, the tiller 100 also has a tilt mechanism 300, which advantageously facilitates selective retainment of the tiller arm 104 in any one of a range of user-selectable tilt positions relative to the tilt axis 299 on the base bracket assembly 102. FIG. 15 illustrates via arrows a range of selectable tilt positions of the tiller arm 104 facilitated by the tilt mechanism 300, including in solid line a horizontal tilt position and in phantom lines a vertical straight upward position and in phantom lines a vertical straight downward position, thus spanning a range of selectable positions that extends through 180 degrees relative to the tilt axis 299 on the base bracket assembly 102. FIG. 16 illustrates the tiller arm 104 in solid lines in the horizontal tilt position and in phantom lines additional upward tilt positions which are in fifteen degree increments relative to each other. As further described herein below, the tilt mechanism 300 advantageously allows the user to move and lock the tiller arm 104 in the illustrated range of tilt positions, including in some examples where the tiller arm 104 is movable at least forty-five degrees downwardly from horizontal, further including in some examples at least seventy-five degrees downwardly from horizontal, and further including in some examples at least ninety degrees downwardly relative to horizontal. As will be further described herein below, the tilt mechanism 300 is engageable to retain the tiller arm 104 in any one of a variety of selected positions. As will be further described herein below, the tilt mechanism 300 is further engageable to lock the tiller arm 104 in the uppermost or lowermost positions.

Referring to FIGS. 9 and 22-28, the tilt mechanism 300 includes a tilt bracket 302 which is fastened to the inner end 200 of the tiller arm 104. The tilt bracket 302 has an inner arm 304 which extends into the interior of the tiller arm 104 defined by the chassis 212 and cover 214. The inner arm 304 is fixed via fasteners 307 extending through the chassis 212 and into engagement with the inner arm 304. The tilt bracket 302 extends from the inner end 200 of the tiller arm 104 and has a body 308. A through-bore 311 extending laterally through the body 308. Ratchet wheels 310 are located on laterally opposite sides of the body 308, each having a series of two-sided angular ratchet recesses 312 located along the outer radius of the rear side of the respective ratchet wheel 310. Upper and lower pairs of locking arms 314, 315 are located axially between the ratchet wheels 306 and radially extend from the body 308 on opposite sides of the series of ratchet recesses 312, respectively. Each of the upper and lower pairs of locking arms 314, 315 provide sidewalls for a respective rectangular-shaped locking recess 316, 317 having a bottom wall and opposing side walls extending upwardly from the bottom wall.

Referring to FIGS. 1 and 4, the tilt mechanism 300 also includes a tilt shaft 320 which extends along a tilt shaft axis 322 and is rotatably supported within the opposed through-bores 142 in the arms 140. A pawl 324 is pinned to the middle of the tilt shaft 320, axially between the arms 140. The pawl 324 is rotatable along with the tilt shaft 320 about the tilt shaft axis 322 and relative to the base bracket assembly 102. The pawl 324 has opposing ratchet surfaces 326 having a series of pointed ratchet protrusions for mating in a meshed engagement with the ratchet recesses 312 on the ratchet wheels 306, as will be further described herein below. The pawl 324 also has a locking bar 328 located axially between the ratchet surfaces 326.

Figure 20:
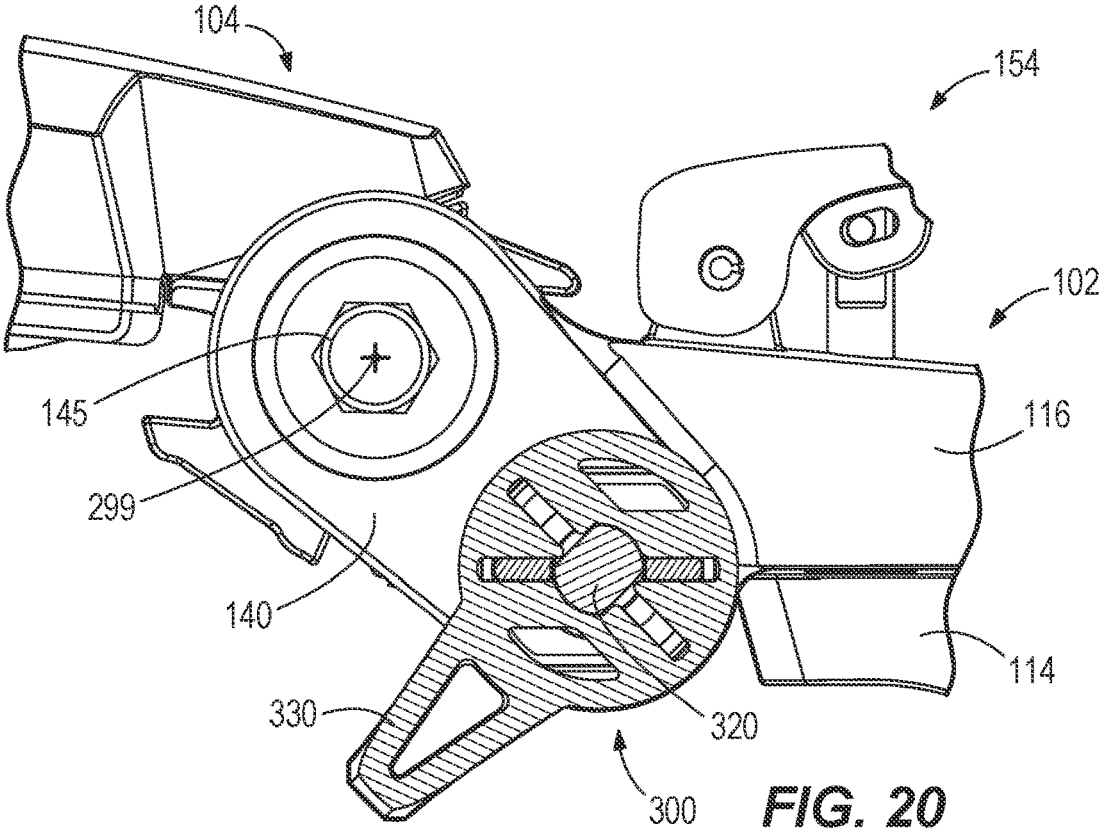
FIG. 20 is a side view illustrating the tilt shaft, tilt lever and cam device of the tilt mechanism in an disengaged position.
Figure 21:
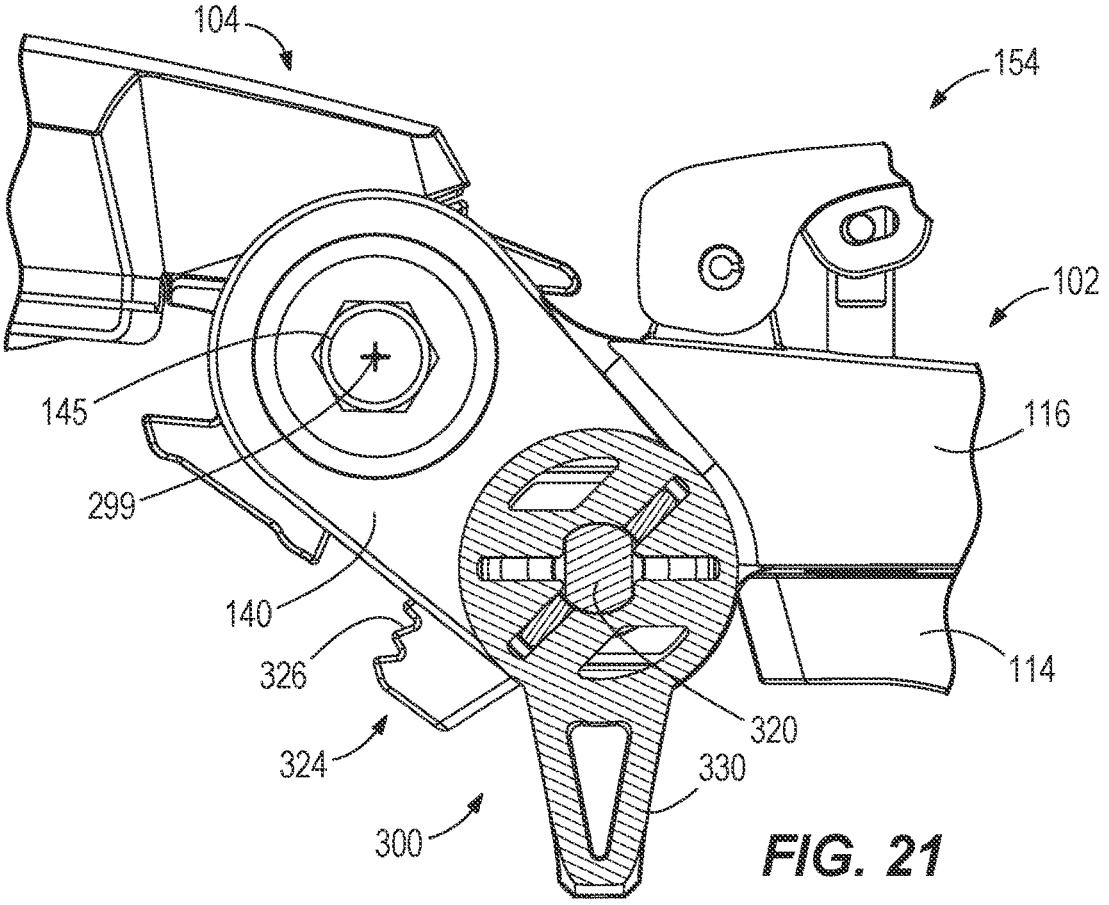
FIG. 21 is a view like FIG. 20 illustrating the tilt mechanism in an engaged position.

Referring to FIG. 4 and FIGS. 17-19, the tilt mechanism 300 further includes tilt levers 330 fastened to each end of the tilt shaft 320. The tilt levers 330 are manually rotatable, which causes rotation of the tilt shaft 320 and pawl 324 about the tilt shaft axis 322 and with respect to the arms 140. A novel cam device 332 is located on one end of the tilt shaft 320. The cam device 332 includes a coil spring 334 disposed on the tilt shaft 320, a cam body 336 on the tilt shaft 320 and a cam receiver 338 formed on the inside surface of the respective tilt lever 330. The spring 334 and cam body 336 are located in a bore 337 in the respective arm 140 such that the cam body 336 remains rotatably fixed relative to the arm 140 but can axially travel with respect to the tilt shaft 320. The coil spring 334 provides a spring bias force that biases the cam body 336 axially outwardly towards the cam receiver 338 in the tilt lever 330. The cam body 336 has axially outwardly facing rounded ridges 340 which are configured to alternately nest in correspondingly contoured surfaces 342 in the cam receiver 338 depending on a rotational position of the tilt lever 330, as will be further described herein below. Generally speaking the contoured surfaces 342 in the cam receiver 338 provide a first elongated pocket for nesting the rounded ridges 340 of the cam body 336 when the tilt mechanism 300 is in the disengaged position (see FIG. 20), and a second elongated pocket for nesting the rounded ridges 340 when the tilt mechanism 300 is in the disengaged position (see FIG. 21). As further described herein below, moving the cam device 332 from one of the disengaged position and engaged position to the other of the disengaged position and engaged position requires application of a rotational force on the cam device 332 that is greater than a cam force provided by the spring 334 plus camming engagement between the rounded ridges 340 and contoured surfaces 342 in the nested orientation of the cam body 336 in the cam receiver 338. The rotational force can be applied by manually rotating the tilt levers 330 or by rotating the tiller arm 104 upwardly into the vertical straight upward position shown in FIG. 15. This causes the contoured surfaces 342 to cammingly engage the rounded ridges 340, which in turn causes the cam body 336 to axially travel inwardly away from the cam receiver 338 along the tilt shaft 320 in the bore 337, against the bias of the spring 334, until the contoured surfaces 342 are removed from the existing pocket in which it resides, which permits further rotation of the tilt levers 330 and corresponding rotation of the tilt shaft 320 and pawl 324 to the other of the disengaged and engaged position, whereafter the spring 334 biases the cam receiver 338 back axially outwardly into engagement with the new pocket. In the illustrated example, the cam device 332 is located on one end of the tilt shaft 320, however in other examples, the tilt mechanism 300 includes cam devices 332 on both ends of the tilt shaft 320. Also, in other examples the orientation of the levers 330 can be flipped 180 degrees to better avoid interference of components.

Figure 22:
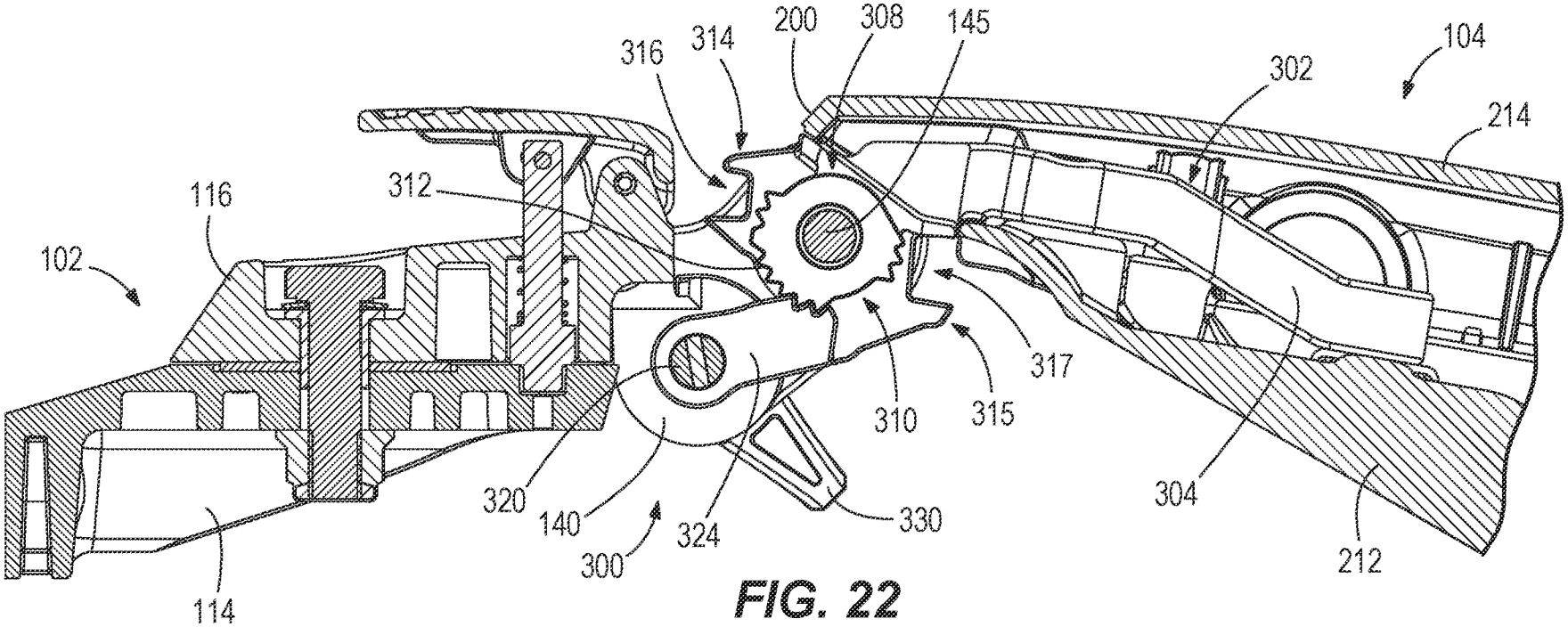
FIG. 22 is a side sectional view illustrating the tilt mechanism in the engaged position with the tiller arm in a tilt position that is slightly downward from horizontal.

FIG. 22 is a side sectional view illustrating the tilt mechanism 300 in an engaged position with the tiller arm 104 in a tilt position that is angled slightly downward from horizontal. The tilt mechanism 300 is illustrated in the engaged position, wherein the spring 334 is biasing the pawl 324 in the counter-clockwise direction in the side perspective of FIG. 22, and such that the opposing ratchet surfaces 326 on the pawl 324 are mated with the first few ratchet recesses 312 on the ratchet wheels 306, respectively. As such, the tiller arm 104 is retained in the illustrated tilt position via engagement between the pawl 324 and the body 308 of the tilt bracket 302.

Figure 23:
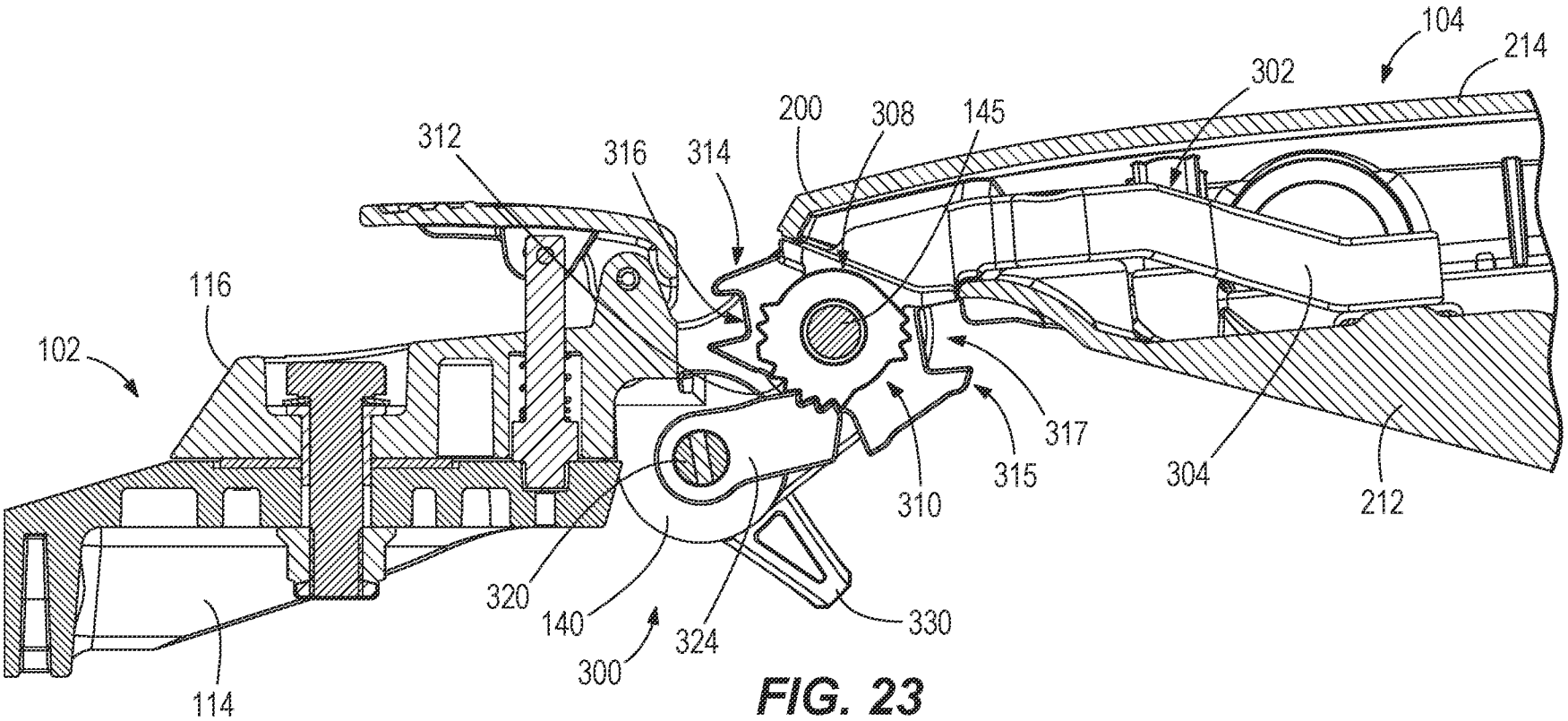
FIG. 23 is a side sectional view illustrating the tilt mechanism in the engaged position with the tiller arm in a horizontal tilt position.

FIG. 23 illustrates the tilt mechanism after a user manually pivots the tiller arm 104 upwardly about the tilt axis 299 defined by the fastener 145, counter-clockwise in the side perspective of FIG. 22. The tilt mechanism 300 remains in the engaged position and the tiller arm 104 is shown in a generally horizontal position relative to the tilt axis 299 and the base bracket assembly 102. Upward pivoting of the tiller arm 104 is permitted by the tilt mechanism 300 via spring-biased ratcheting movement of the pawl 324 along the ratchet wheels 306, particularly as the ratchet surfaces 326 on the pawl 324 ratchet along the ratchet recesses 312 of the ratchet wheels 310, respectively, until the tiller arm 104 is brought to a rest position, which permits the spring 334 to rotate the pawl 324 towards the tilt bracket 302, causing meshed engagement between the ratchet surfaces 326 and ratchet recesses 312. The spring bias is provided by the axial bias of spring 334, pushing the cam body 336 axially into engagement with the cam receiver 338 such that the rounded ridges 340 tend to remain nested in the pocket corresponding to the locked position. As the tiller arm 104 is rotated upwardly, the ratchet surfaces 326 move along the ratchet surfaces 326, which causes slight counter-clockwise and clockwise movements of the pawl 324 and tilt shaft 320 about the tilt shaft axis 322. Such movements of the pawl 324 and tilt shaft 320 is facilitated by the counter-acting forces provided by the cam device 332. In particular, slight clockwise rotation of the pawl 324 and tilt shaft 320 is facilitated by camming engagement of the rounded ridges 340 upwardly along the contoured surfaces 342 of the respective pocket. Slight clockwise (return) rotation is cause by the bias of the spring 334, pushing the cam body 336 axially towards the cam receiver 338, which causes the rounded ridges 340 to cam back down along the contoured surfaces 342 into a fully nested position. Compared to the downwardly angled position shown in FIG. 22, more of the ratchet surfaces 326 are engaged with ratchet recesses 312 on the ratchet wheels 310.

Figure 24:
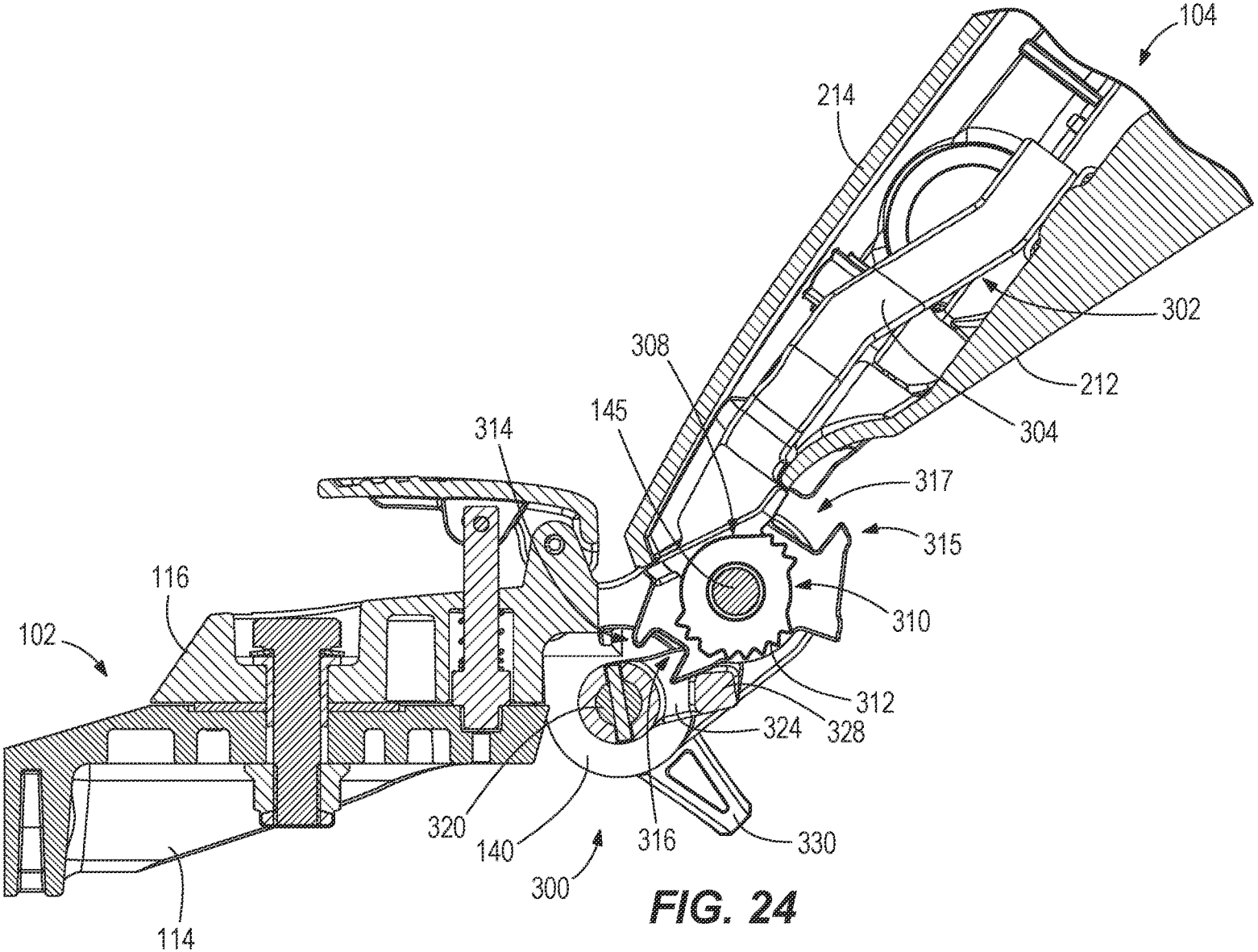
FIG. 24 is a side sectional view illustrating the tiller arm as it is pivoted upwardly towards the uppermost, vertically straight up tilt position and illustrating a tilt bracket of the tilt mechanism as it engages a pawl of the tilt mechanism in such a way that moves the tilt mechanism into the disengaged position by overcoming a cam force provided by the cam device.
Figure 25:
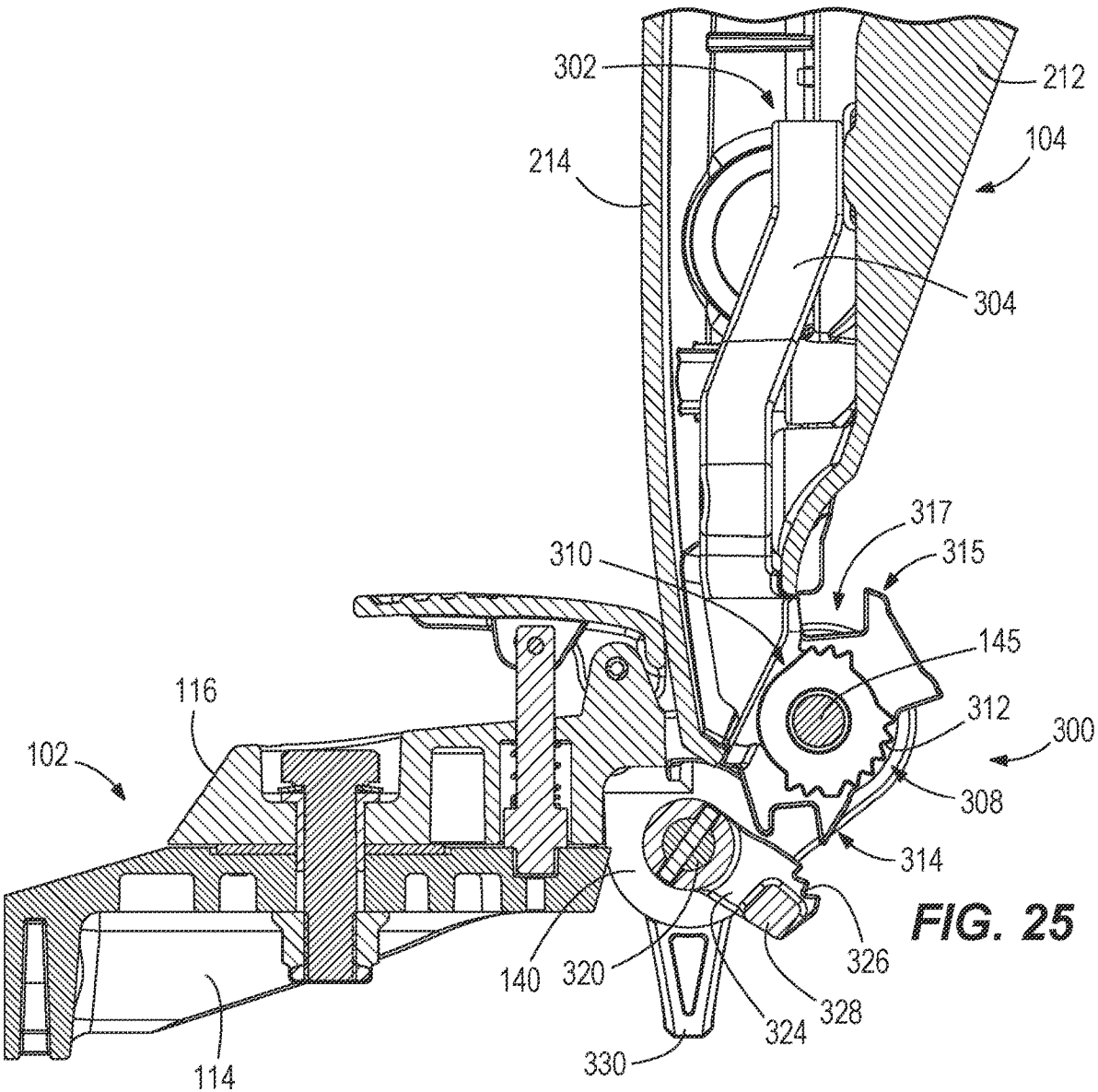
FIG. 25 is a side sectional view illustrating the tilt mechanism in the disengaged position and the tiller arm in the uppermost, vertically straight up tilt position.

FIG. 24 illustrates the tiller arm 104 as it is manually pivoted further upwardly relative to the tilt axis 299, further counter-clockwise in the side perspective of FIG. 24. Such upward pivoting of the tiller arm 104 relative to the tilt axis 299 brings the outside edge of the upper locking arms 314 into engagement with the upper surface of the locking bar 328 on the pawl 324, as shown. When the tiller arm 104 is further rotated upwardly from the position shown in FIG. 24, with a rotational force that is greater than the above-noted cam force provided by the cam device 332, the outside edge of the upper locking arms 314 forces the pawl 324 to rotate downwardly, clockwise in the side perspective of FIG. 24. More specifically, the rotational force applied on the pawl 324 and tilt shaft 320 rotates the cam receiver 338 relative to the cam body 336, which causes the rounded ridges 340 of the cam body 336 to travel upwardly along the contoured surfaces 342 of the cam receiver 338, against the bias of the spring 334, until the rounded ridges 340 fully leave the noted pocket corresponding to the engaged position and become aligned with and nested in the noted pocket corresponding to the disengaged position. This simultaneously causes the tilt shaft 320 and tilt levers 330 to also rotate downwardly until the pawl 324 is rotated out of the way of the tilt bracket 302, as shown in FIG. 25. Thus manually pivoting of the tiller arm 104 upwardly into the position shown in FIG. 25 automatically frees the tiller arm 104 to be pivoted back downwardly to any angle.

Figure 26:
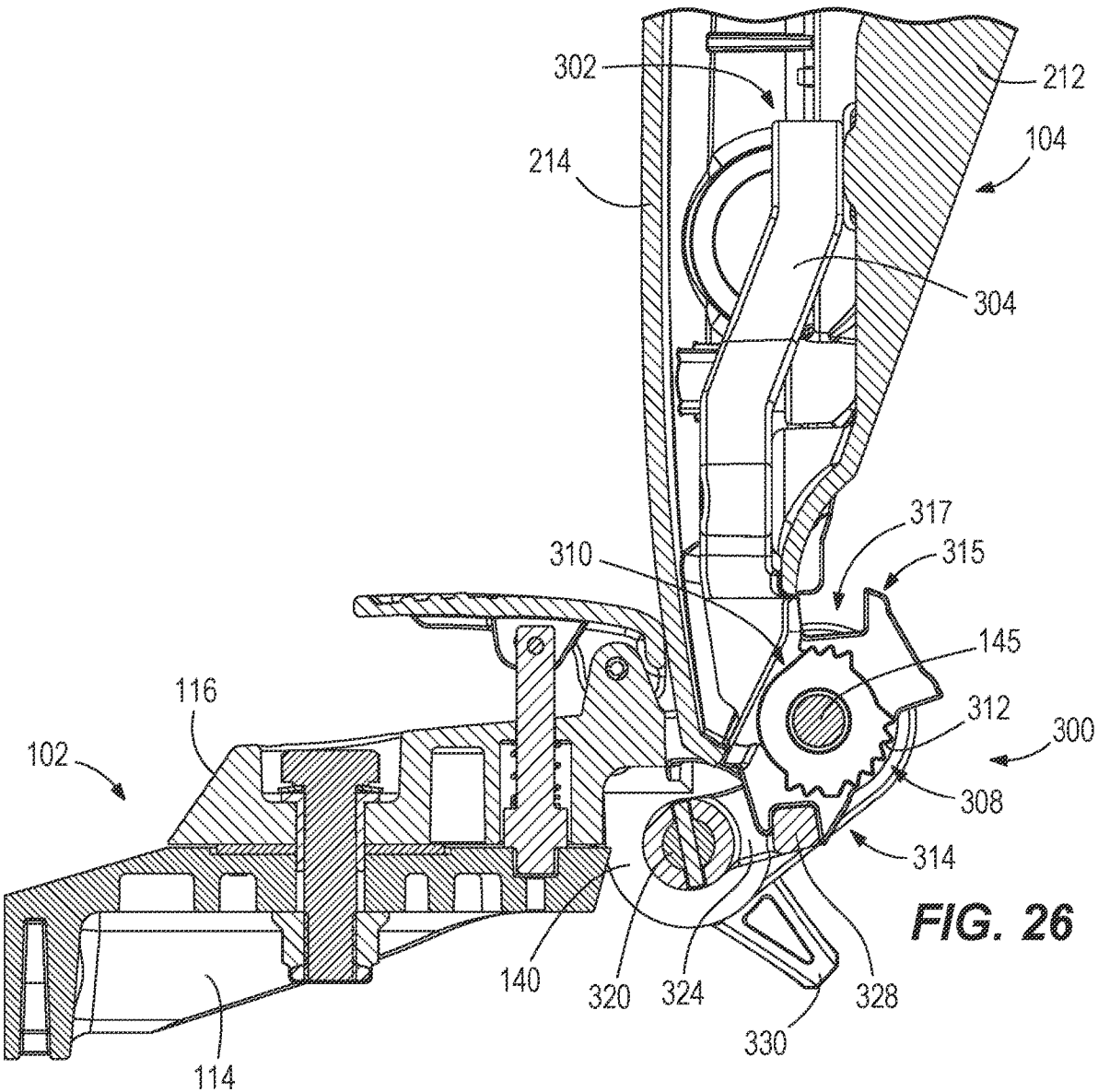
FIG. 26 is a side sectional view illustrating the tilt mechanism in the engaged position and the tiller arm in the uppermost, vertically straight up tilt position.

As shown in FIG. 26, if the user wants to lock the tiller arm 104 in the vertical upward position, the user manually rotates one or both of the tilt levers 330 with a force that is greater than the cam force provided by the cam device 332. This overcomes the bias of the spring 334 and the nested surfaces of the cam body 336 and cam receiver 338 and rotates the locking bar 328 of the pawl 324 into locking engagement with the recess 316 provided by the upper locking arms 314, effectively locking the tiller arm 104 in place.

Figure 27:
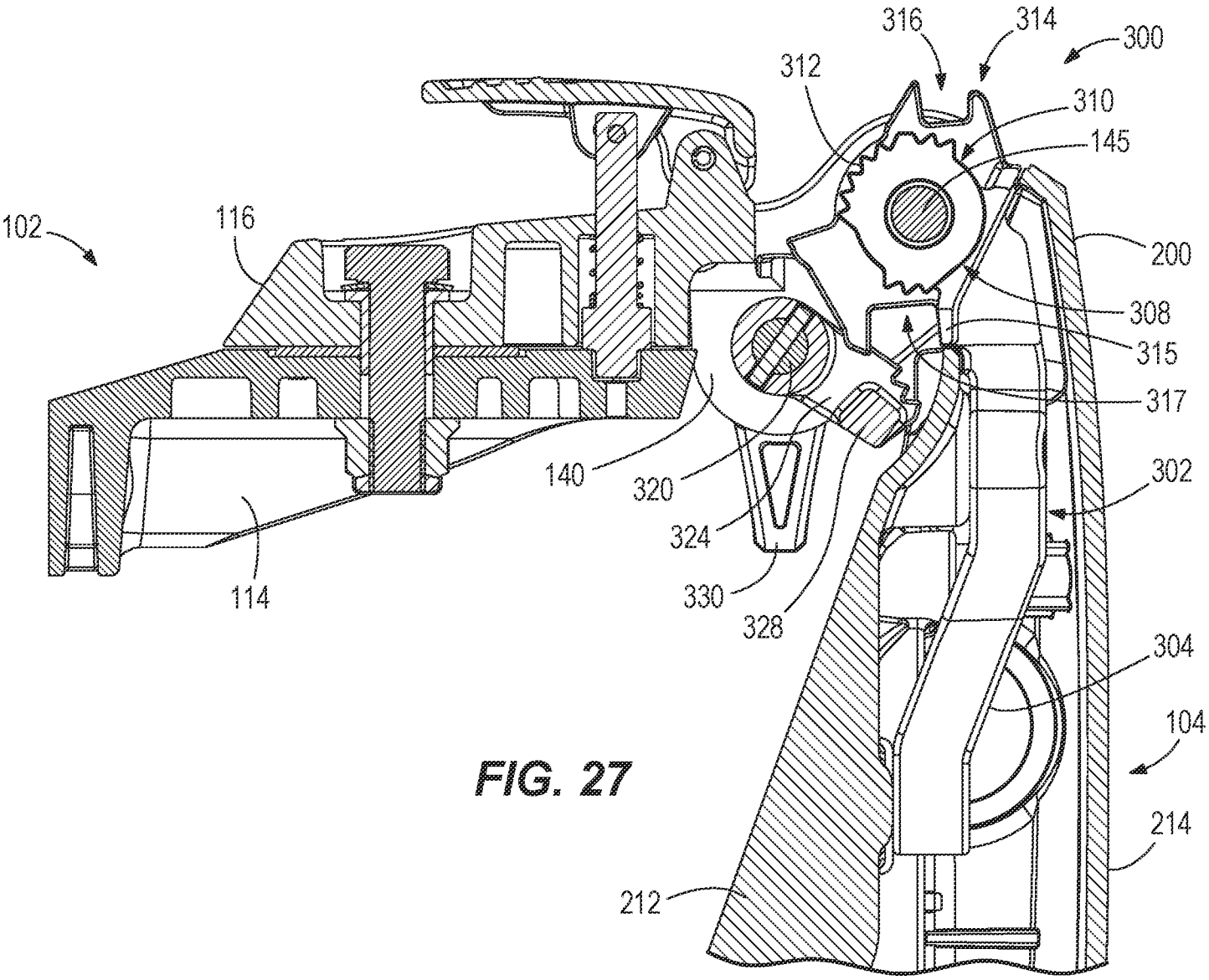
FIG. 27 is a side sectional view illustrating the tilt mechanism in the disengaged position and the tiller arm in the lowermost, vertically straight down tilt position.
Figure 28:
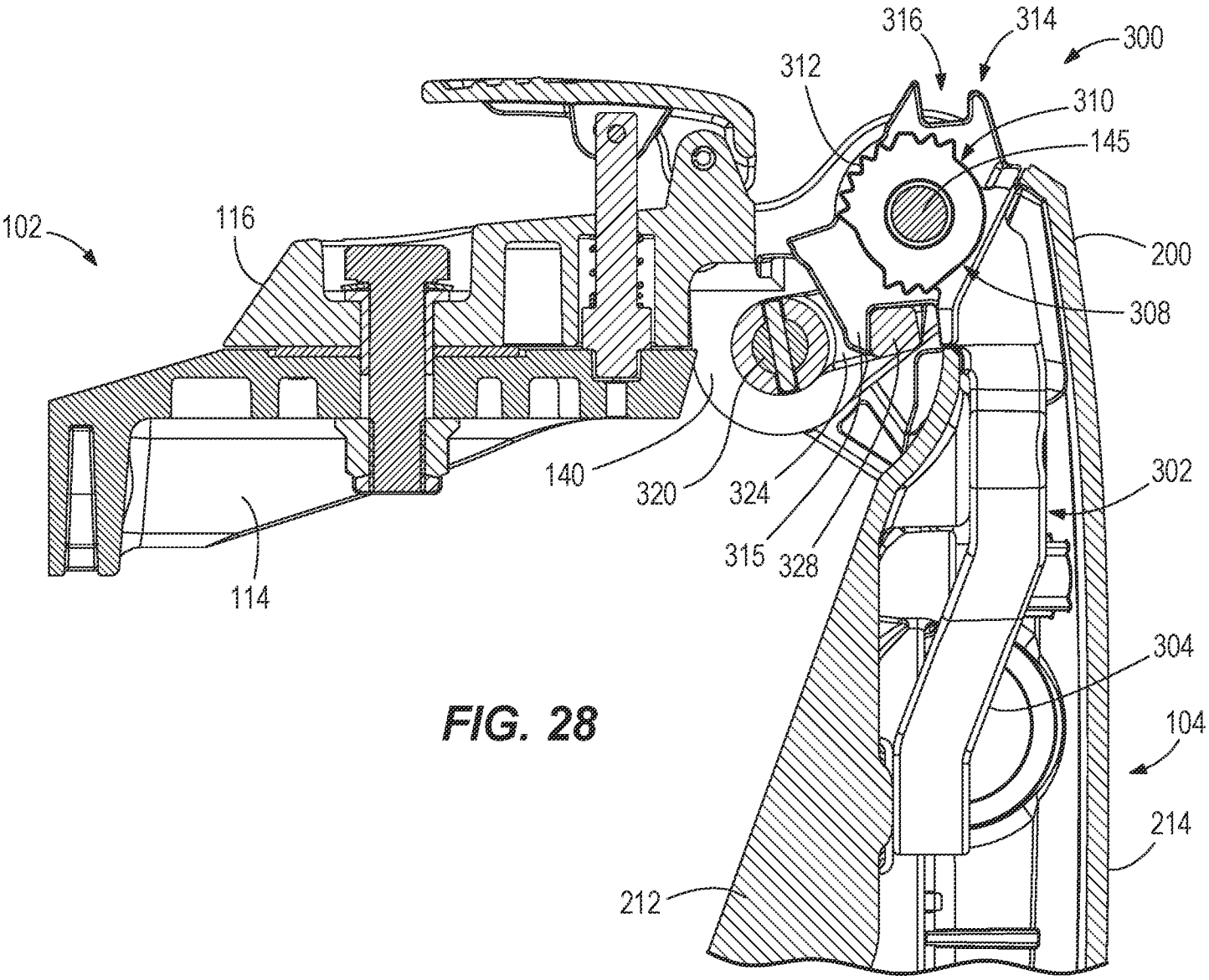
FIG. 28 is a side sectional view illustrating the tilt mechanism in the engaged position with the tiller arm in a vertically straight down tilt position.

As shown in FIGS. 27-28, if the user wants to unlock the tiller arm 104 and move it downwardly, for example to the vertically straight downward position shown, the user manually rotates one or both of the tilt levers 330 with a force that is greater than the noted cam force. This rotates the locking bar 328 of the pawl 324 downwardly, clockwise in the side view of FIGS. 27-28. This removes the locking bar 328 from the recess 316 and frees the tilt bracket 302 from the pawl 324 and permits the user to manually lower the tiller arm 104 about the tilt axis 299 into the vertically straight downward position shown. Thereafter the user can again rotate the tilt levers 330 counter-clockwise, which brings the locking bar 328 of the pawl 324 into locking engagement with the recess 317 defined by the lower locking arms 315. This effectively locks the tiller arm 104 in place with a robust tilt mechanism which can be made strong enough to permit a user to carry the associated marine drive via the tiller arm 104 in the position shown in FIG. 28.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

The invention claimed is:

1. A tiller for a marine drive, the tiller comprising, a base bracket assembly configured for fixed attachment to a marine drive;

a tiller arm coupled to the base bracket assembly, the tiller arm being pivotable about a tilt axis relative to the base bracket assembly; and a tilt mechanism comprising a tilt bracket coupled to a first one of the base bracket assembly or the tiller arm and a pawl coupled to a second one of the base bracket assembly or tiller arm, wherein the tilt mechanism is movable into an engaged position in which the pawl engages the tilt bracket to retain the tiller arm in a selected one of a range of tilt positions relative to the base bracket assembly, and into a disengaged position in which the pawl is disengaged from the tilt bracket such that the tiller arm is freely pivotable about the tilt axis relative to the base bracket assembly;

wherein the range of tilt positions comprises a downward tilt position in which the tiller arm is angled downwardly relative to horizontal so as to facilitate carrying of the marine drive via the tiller arm, the tilt bracket comprises a ratchet wheel having an outer radius with a series of recesses corresponding to the range of tilt positions, the pawl ratchets across and engages with each recess in the series of recesses when the tiller arm is pivoted upwardly about the tilt axis, the pawl is spring-biased into contact with the ratchet wheel when the tilt mechanism is in the engaged position, and wherein the tilt bracket comprises an uppermost recess corresponding to an uppermost tilt position in the range of tilt positions and a lowermost recess corresponding to a lowermost tilt position in the range of tilt positions.

2. The tiller according to claim 1, wherein the lowermost recess comprises a bottom wall and opposing sidewalls whichthat each engage with an end wall and sidewalls of the pawl, respectively, to securely lock the tiller arm in the lowermost tilt position.

3. The tiller according to claim 1, wherein the uppermost recess comprises a bottom wall and opposing sidewalls that engage with an end wall and sidewalls of the pawl, respectively, to securely lock the tiller arm in the uppermost tilt position.

4. A tiller for a marine drive, the tiller comprising:

a base bracket assembly configured for fixed attachment to a marine drive;

a tiller arm coupled to the base bracket assembly, the tiller arm being pivotable about a tilt axis relative to the base bracket assembly; and a tilt mechanism comprising a tilt bracket coupled to a first one of the base bracket assembly or the tiller arm and a pawl coupled to a second one of the base bracket assembly or tiller arm, wherein the tilt mechanism is movable into an engaged position in which the pawl engages the tilt bracket to retain the tiller arm in a selected one of a range of tilt positions relative to the base bracket assembly, and into a disengaged position in which the pawl is disengaged from the tilt bracket such that the tiller arm is freely pivotable about the tilt axis relative to the base bracket assembly;

wherein the range of tilt positions comprises a downward tilt position in which the tiller arm is angled downwardly relative to horizontal so as to facilitate carrying of the marine drive via the tiller arm, and wherein the pawl is coupled to the second one of the base bracket assembly and the tiller arm by a tilt shaft that defines a tilt shaft axis about which the pawl is pivotable into the engaged position and the disengaged position.

5. The tiller according to claim 4, wherein the pawl is coupled to a cam device that provides a cam force retaining the tilt mechanism in the engaged position and alternately retaining the tilt mechanism in the disengaged position.

6. A tiller for a marine drive, the tiller comprising:

a base bracket assembly configured for fixed attachment to a marine drive;

a tiller arm coupled to the base bracket assembly, the tiller arm being pivotable about a tilt axis relative to the base bracket assembly; and a tilt mechanism comprising a tilt bracket coupled to a first one of the base bracket assembly or the tiller arm and a pawl coupled to a second one of the base bracket assembly or tiller arm, wherein the tilt mechanism is movable into an engaged position in which the pawl engages the tilt bracket to retain the tiller arm in a selected one of a range of tilt positions relative to the base bracket assembly, and into a disengaged position in which the pawl is disengaged from the tilt bracket such that the tiller arm is freely pivotable about the tilt axis relative to the base bracket assembly;

wherein the pawl is coupled to the second one of the base bracket assembly and the tiller arm by a tilt shaft that defines a tilt shaft axis about which the pawl is pivotable into the engaged position and the disengaged position, and wherein the pawl is coupled to a cam device that provides a cam force retaining the tilt mechanism in the engaged position and alternately retaining the tilt mechanism in the disengaged position.

7. A tiller for a marine drive, the tiller comprising:

a base bracket assembly configured for attachment to a marine drive;

a tiller arm coupled to the base bracket assembly, the tiller arm being pivotable about a tilt axis relative to the base bracket assembly; and a tilt mechanism including a ratchet wheel on a first one of the base bracket assembly or the tiller arm and a pawl on a second one of the base bracket assembly or the tiller arm;

wherein the tilt mechanism is movable into an engaged position in which the pawl ratchets across the ratchet wheel and is configured to engage the ratchet wheel to retain the tiller arm in a selected one of a range of tilt positions, and into a disengaged position in which the tiller arm is freely pivotable relative to the range of tilt positions;

wherein the tiller arm is further pivotable about the tilt axis into a downward tilt position in which the tiller arm is angled downwardly relative to the range of tilt positions, and wherein the tilt mechanism includes a locking recess corresponding to the downward tilt position, the pawl being movable to engage the locking recess so as to lock the tiller arm in the downward tilt position and facilitate carrying of the marine drive via the tiller arm.

8. The tiller according to claim 7, wherein the locking recess includes a bottom wall and opposing sidewalls that are engaged by an end wall and sidewalls of the pawl, respectively, to lock the tiller arm in the downward tilt position.

9. The tiller according to claim 7, wherein the tiller arm is further pivotable about the tilt axis into an upward tilt position in which the tiller arm is angled upwardly relative to the range of tilt positions, and wherein the tilt mechanism includes a locking recess that corresponds to the upward tilt position, the pawl being movable to engage the locking recess that corresponds to the upward tilt position so as to lock the tiller arm in the upward tilt position.

10. The tiller according to claim 9, wherein the locking recess that corresponds to the upward tilt position includes a bottom wall and opposing sidewalls that are engaged by an end wall and sidewalls of the pawl, respectively, to lock the tiller arm in the upward tilt position.

11. The tiller according to claim 7, wherein in the tiller arm in the downward tilt position extends about ninety degrees downwardly relative to horizontal.

12. The tiller according to claim 7, wherein the ratchet wheel includes a series of ratchet recesses corresponding to the range of tilt positions, the pawl being configured to ratchet across the series of ratchet recesses as the tiller arm is pivoted upwardly about the tilt axis.

13. The tiller according to claim 12, wherein the pawl is spring-biased into contact with the ratchet wheel when the tilt mechanism is in the engaged position.

14. The tiller according to claim 7, wherein the pawl is coupled to the second one of the base bracket assembly and the tiller arm by a tilt shaft that defines a tilt shaft axis about which the pawl is pivotable into the engaged position and the disengaged position.

15. The tiller according to claim 14, further comprising a cam device providing a cam force that retains the tilt mechanism in the engaged position and that alternately retains the tilt mechanism in the disengaged position.

16. The tiller according to claim 15, wherein the cam device includes a cam body on the first one of the base bracket assembly and the tilt shaft and a cam receiver on the second one of the base bracket assembly and the tilt shaft, the cam body having contoured surfaces that engage with corresponding contoured surfaces in the cam receiver.

17. The tiller according to claim 16, wherein the contoured surfaces on the cam body comprise rounded ridges and the contoured surfaces in the cam receiver comprise rounded recesses.

18. The tiller according to claim 16, further comprising a tilt lever coupled to an end of the tilt shaft so that pivoting of the tilt lever causes rotation of the tilt shaft and the pawl about the tilt shaft axis, and wherein the first one of the cam body and the cam receiver are on the tilt lever and the second one of the cam body and the cam receiver are on the tilt lever, and wherein manually rotating the tilt lever in a first direction by a force that exceeds the cam force moves the tilt mechanism into the disengaged position and so that manually rotating the tilt lever in a second direction that is opposite the first direction by a force that exceeds the cam force moves the tilt mechanism into the engaged position.

19. A tiller for a marine drive, the tiller comprising:

a base bracket assembly configured for attachment to a marine drive;

a tiller arm coupled to the base bracket assembly, the tiller arm being pivotable about a tilt axis relative to the base bracket assembly; and a tilt mechanism including a ratchet wheel on a first one of the base bracket assembly or the tiller arm and a pawl on a second one of the base bracket assembly or the tiller arm;

wherein the tilt mechanism is movable into an engaged position in which the pawl ratchets across the ratchet wheel and is configured to engage the ratchet wheel to retain the tiller arm in a selected one of a range of tilt positions, and into a disengaged position in which the tiller arm is freely pivotable relative to the range of tilt positions;

wherein the tiller arm is further pivotable about the tilt axis into a downward tilt position in which the tiller arm is angled downwardly relative to the range of tilt positions, and a locking member that is pivotable into engagement with a locking recess to lock the tiller arm in the downward tilt position and facilitate carrying of the marine drive via the tiller arm.

20. The tiller according to claim 19, wherein the locking member is on a first one of the base bracket assembly or the tiller arm and the locking recess is on the second one of the base bracket assembly or the tiller arm.

21. The tiller according to claim 19, wherein the pawl includes the locking member.

22. The tiller according to claim 19, wherein the locking member is a bar on the pawl.

23. The tiller according to claim 19, wherein the ratchet wheel includes a series of ratchet recesses corresponding to the range of tilt positions, the pawl being configured to ratchet across the series of ratchet recesses as the tiller arm is pivoted upwardly about the tilt axis, and wherein the locking recess is defined by a locking arm on one side of the series of ratchet recesses.

24. The tiller according to claim 19, wherein the tiller is further pivotable about the tilt axis into an upward tilt position in which the tiller arm is angled upwardly relative to the range of tilt positions, and wherein the locking member is configured to lock the tiller arm in the upward tilt position so that the tiller arm is prevented from pivoting out of the upward tilt position about the tilt axis.

25. The tiller according to claim 24, wherein the ratchet wheel includes a series of ratchet recesses corresponding to the range of tilt positions, the pawl being configured to ratchet across the series of ratchet recesses as the tiller arm is pivoted upwardly about the tilt axis, and wherein the locking member is configured to engage a locking recess defined by a locking arm on one side of the series of ratchet recesses to lock the tiller arm in the upward tilt position.

* * * * *